United States Patent [19]

Keene et al.

[11] Patent Number: 4,564,150

[45] Date of Patent: Jan. 14, 1986

[54] APPARATUS FOR CONTINUOUSLY SUPPLYING A WEB OF SHEET MATERIAL

[75] Inventors: John F. Keene, Roscoe; Bengt L. Kuller, Rockford; Robert G. Kemmeter, Rockton, all of Ill.

[73] Assignee: Enkel Corporation, Rockford, Ill.

[21] Appl. No.: 555,823

[22] Filed: Nov. 28, 1983

[51] Int. Cl.[4] ..... B65H 19/18; B65H 19/30; B65H 23/08

[52] U.S. Cl. ..... 242/58.1; 242/58.6; 242/75.41

[58] Field of Search ..... 242/58, 58.1, 58.2, 242/58.3, 58.4, 58.5, 58.6, 75.41, 75.42

[56] References Cited

U.S. PATENT DOCUMENTS

| | | | |
|---|---|---|---|
| 1,409,659 | 3/1922 | Brewer . | |
| 1,949,238 | 2/1934 | Broadmeyer | 242/58 |
| 2,018,842 | 10/1935 | Durham | 242/58.1 |
| 2,196,612 | 4/1940 | Scott | 242/58.1 |
| 3,167,269 | 1/1965 | Giles | 242/58.4 |
| 4,173,314 | 11/1979 | Curran et al. | 242/58 |

FOREIGN PATENT DOCUMENTS 366966 6/1971 Sweden .

*Primary Examiner*—Stuart S. Levy
*Assistant Examiner*—Lloyd D. Doigan
*Attorney, Agent, or Firm*—Leydig, Voit & Mayer, Ltd.

[57] ABSTRACT

Apparatus for continuously supplying a web of sheet material wound on rolls includes a conveyor which carries a roll from a loading station to a splicing station and then to an active or running station. While a running web is being drawn off a roll at the active station, a standby roll is loaded on the conveyor at the loading station and then it is advanced to the splicing station. A stationary core brake located at the active station is responsive to the tension of the running web and applies a drag to the core on which the web of the active roll is wound to maintain the tension at a selected level. When the web on the active roll is nearly exhausted, an endless belt in frictional engagement with the standby roll is driven by a motor and accelerates the roll until the peripheral speed of the latter is equal to about 99 percent of the linear speed of the running web and then the belt is driven from the running web so that the two speeds match. At that time, the web on the active roll is spliced to the web of the standby roll, which thus becomes the new active roll, and the core brake stops the core of the first active roll. Simultaneously, a stationary brake responsive to the tension of the web running from the second active roll applies a drag to the periphery of the latter through the belt to maintain the tension in the new running web. As the new active roll is advanced to the active station, the belt moves with it so that the belt brake continues to control the tension of its web. The belt brake continues this control until the new active roll is in the active station and the core brake is engaged with the roll and energized at which time the belt brake is simultaneously deenergized to complete the transfer of the running web from the first roll to the second.

15 Claims, 26 Drawing Figures

℄ STATION B
11
14
37
38
49
50
80
85
89
90
91
92
93
94
95
96
97
98
99
100
101
102
103
104
105
111
112
113
114
115
117
118
119
120
121
122

234
85
87
88
242
47
232
233
43
45
211
48
212
215
209
89
208
49
14
224
226
225
213
210
216
218
217
227
228
229
230
231
219
220
221
222
223

APPARATUS FOR CONTINUOUSLY SUPPLYING A WEB OF SHEET MATERIAL

BACKGROUND OF THE INVENTION

This invention relates to an apparatus for continuously supplying a web of sheet material wound on a roll to a machine, such as a printing press, which draws the web off the roll. In such an apparatus, the web is drawn from an active roll at an active station and, when the running web is nearly exhausted, it is spliced to the web of a standby roll located at a splicing station. Preparatory to splicing, the standby roll is turned and accelerated until its peripheral speed is equal to the linear speed of the running web and then the running web is pasted to the web on the standby roll and severed from the active roll. Thereafter, the standby roll is moved to the active station while the web is being drawn from it and this roll becomes the new active roll. While the running web is being drawn from the active roll, a core brake responsive to the tension of the running web applies a drag to the core on which the web is wound to control the web tension. The active and the standby rolls turn about horizontally spaced parallel axes and a conveyor advances the new active roll from the standby station to the active station. An example of such an apparatus is disclosed in Curran et al U.S. Pat. No. 4,173,314.

SUMMARY OF THE INVENTION

The general object of the invention is to provide a new and improved apparatus of the foregoing type which accurately matches the peripheral speed of the standby roll with the linear speed of the running web to insure reliable splicing of the webs and which utilizes a novel arrangement for continuously controlling the web tension from the time the splice is made until the new active roll is transferred to the active station and control of the tension is assumed by the core brake.

A more detailed object is to employ a power actuator for a drive member which frictionally engages the periphery of the standby roll and use the actuator to accelerate the roll until its peripheral speed nearly matches the linear speed of the running web and then to drive the member directly from the running web so that the two speeds are accurately matched when the splice is made.

A further object is to use an endless belt as the drive member frictionally engaging the periphery of the standby roll and to drive the belt through a clutch means which shifts the drive from the power actuator to the running web when the peripheral speed of the roll nearly equals the linear speed of the web.

Another important object is to have a member in frictional engagement with the periphery of the standby roll and driven by the latter when the splice is made and to employ a second brake which is responsive to the tension of the new running web and which applies a drag to the member to control the tension until the roll is advanced to the active station and the tension control is transferred to the core brake.

Still another object is to mount the driven member to move with the new running roll and to remain in frictional driving engagement with the latter as the roll is advanced to the active station.

A further object is to employ an endless belt as the member driven by the new running roll and to keep the belt in engagement with the roll during transfer by swinging the belt about the axis of one of the pulleys over which it is trained.

In more detailed aspects, it also is an object to apply a drag to the roll and control web tension by means of the same member as is used to accelerate the roll preparatory to splicing.

Another object is to provide a novel clutching assembly by which the movable member of the core brake is smoothly coupled to the rotating core of the new running roll in preparation for the transfer of web tension control to the core brake from the second brake.

The invention also resides in the details of the various components used for accelerating the standby roll and for controlling the tension of the new running web.

DETAILED DESCRIPTION OF THE PREFERRED EMBODIMENT

Figure 1A:
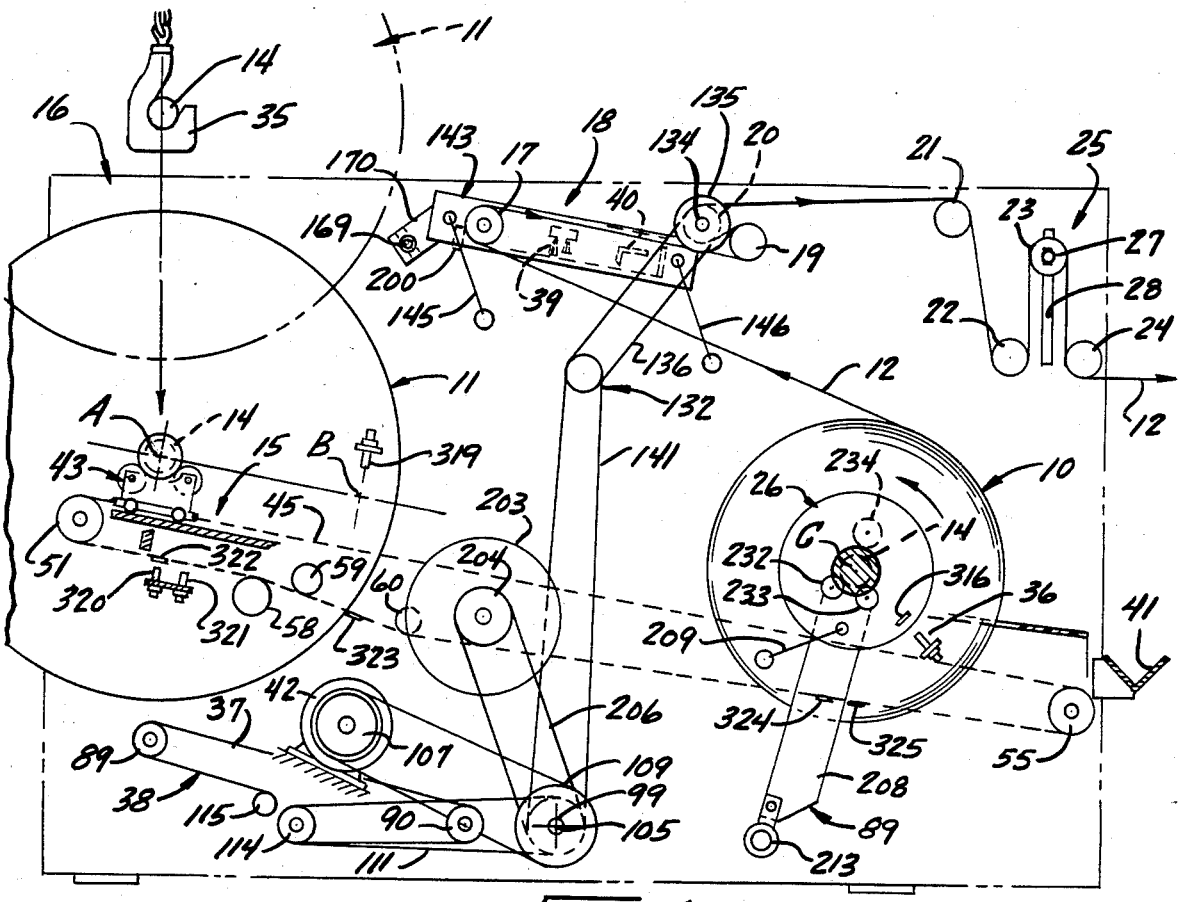
FIG. 1*a* is a schematic side view of an apparatus embodying the present invention.

As shown in the drawings for purposes of illustration, the invention is embodied in an apparatus for continuously supplying a web of sheet material wound on rolls to a machine which utilizes the web. For example, the web may be paper supplied to a printing press. Such an apparatus supports an active roll 10 of web material and a standby roll 11 with the web 12 being drawn off the active roll as by the printing press and the web 13 of the standby roll being spliced to the web 12 just before the web of the active roll is exhausted (see FIGS. 1*a* through 1*b*). The standby roll then becomes the active roll and a new standby roll is loaded into the apparatus. The web of each roll is wound on an elongated core 14 which supports the roll for rotation about the axis of the core and which is reusable.

Herein, a new roll is loaded onto a carrier 15 which is supported on an elongated stationary base or frame 16 and which advances the roll from a loading station A to a splicing station B and then to a running station C. As supported by the carrier, the cores 14 of the rolls are horizontal and extend transversely of the frame and the carrier advances the rolls sidewise in a generally horizontal direction. The web 12 from the active roll 10 at the running station is trained around a roller 17 on a splicing mechanism 18, around idler rollers 19, 20 and 21 and around the idler rollers 22, 23 and 24 of the dancer 25 of a web tensioning device. As is well known in the art, the latter includes an electromagnetic core brake 26 (FIG. 2) which applies a frictional drag to the core 14 of the roll 10 and which is energized in response to the dancer. Thus, the rollers 22 and 24 are stationary on the frame 16 while the roller 23 turns on a shaft 27 which is vertically slidable in a slot 28 in the frame. The roller 23 is urged upwardly against the tension of the web 12 and, for this purpose, pressure fluid such as compressed air is directed to the rod end of a cylinder 29 (FIG. 2) and a flexible cable 30 extends around a pulley 31 carried by the piston rod 32 of the cylinder. On one side of the pulley, the cable is anchored to the frame as indicated at 33 and, on the other side, the cable extends over a control pulley 34 and is connected to the shaft 27 of the roller 23. With this arrangement, the shaft 27 moves up in the slot 28 upon a decrease in web tension and down when the tension increases. The position of the shaft is sensed by a potentiometer 25*a* associated with the control pulley 34 and, through a suitable control circuit, the potentiometer controls the energization of the core brake 26, the energization being increased with a decrease in web tension and decreased with an increase in tension. From the dancer 25, the web 12 travels to the press (not shown) which actually is drawing the web off the active roll.

While the web 12 is being drawn from an active roll 10, a new standby roll 11 is lowered onto the carrier 15 as by means of the hook 35 of a crane (FIG. 1*a*) so that this roll is disposed at the station A. Subsequently, the standby roll is advanced by the carrier to the splicing station B and when, as will be explained later in more detail, a sensor 36 detects that the active roll is nearly exhausted, the splicing of the running web 12 to the web 13 on the standby roll is initiated. Thus, a part 37 of an accelerator mechanism 38 at the station B frictionally engages the periphery of the standby roll to turn the latter about the axis of its core 14. When the standby roll has been fully accelerated, the operation of the splicing mechanism 18 is effected, that is, a brush 39 produces an adhesive seal between the webs 12 and 13 and then a knife 40 severs the exhausting active roll from the combined web. As a result, the web from the standby roll 11 at the station B is being supplied to the press.

After the splice has been completed, the core 14 of the exhausted or depleted roll is released from the station C and rolls to the rear end of the frame 16 where it is caught in a trough 41 (see FIGS. 1*c* and 1*d*) where it later may be retrieved for reuse. Then, while the web 13 is being drawn from the new roll 11, the latter is advanced by the carrier 15 from the splicing station B to the running station C and this roll becomes the active roll. The carrier then is conditioned to receive another full roll at the loading station A and, thus, the apparatus provides a continuous supply of web even though periodically a depleted roll is replaced by a new roll.

The present invention contemplates the provision of an apparatus of the foregoing type with a novel arrangement for turning and accelerating the standby roll 11 so that the peripheral speed of this roll closely matches, or even perfectly matches, the linear speed of the web 12 from the active roll 10 when the splice is made. This assures an effective and even splice is achieved without tearing the webs and without surges of tension in the webs. In general, the foregoing is achieved by first driving the part 37 of the accelerator mechanism 38 from an independent source of power wich accelerates the rotation of the standby roll to a speed near the desired speed and then changing to a drive directly responsive to the linear speed of the web 12 to complete the acceleration. More specifically, the initial acceleration is produced by a power actuator 42 which drives the part 37 through a clutch means while the drive from the web 12 also is through this clutch means and the latter is contolled to shift the drive from the power actuator to the web responsive means for the final acceleration.

Herein, the accelerator mechanism 38 is disposed beneath the roll 11 and is mounted on the frame 16 to move between an inactive position and a driving position. In the inactive position, the drive part 37 is spaced from the roll to permit the latter to be advanced by the carrier 15 from the station A to the station B. Thereafter, the mechanism is shifted to its driving position to move the part 37 up into frictional driving engagement with the roll. The latter is supported on the carrier for free rotation so that it may be turned about the axis of its core 4 when the power actuator 42 is energized to drive the part 37.

Figure 2:
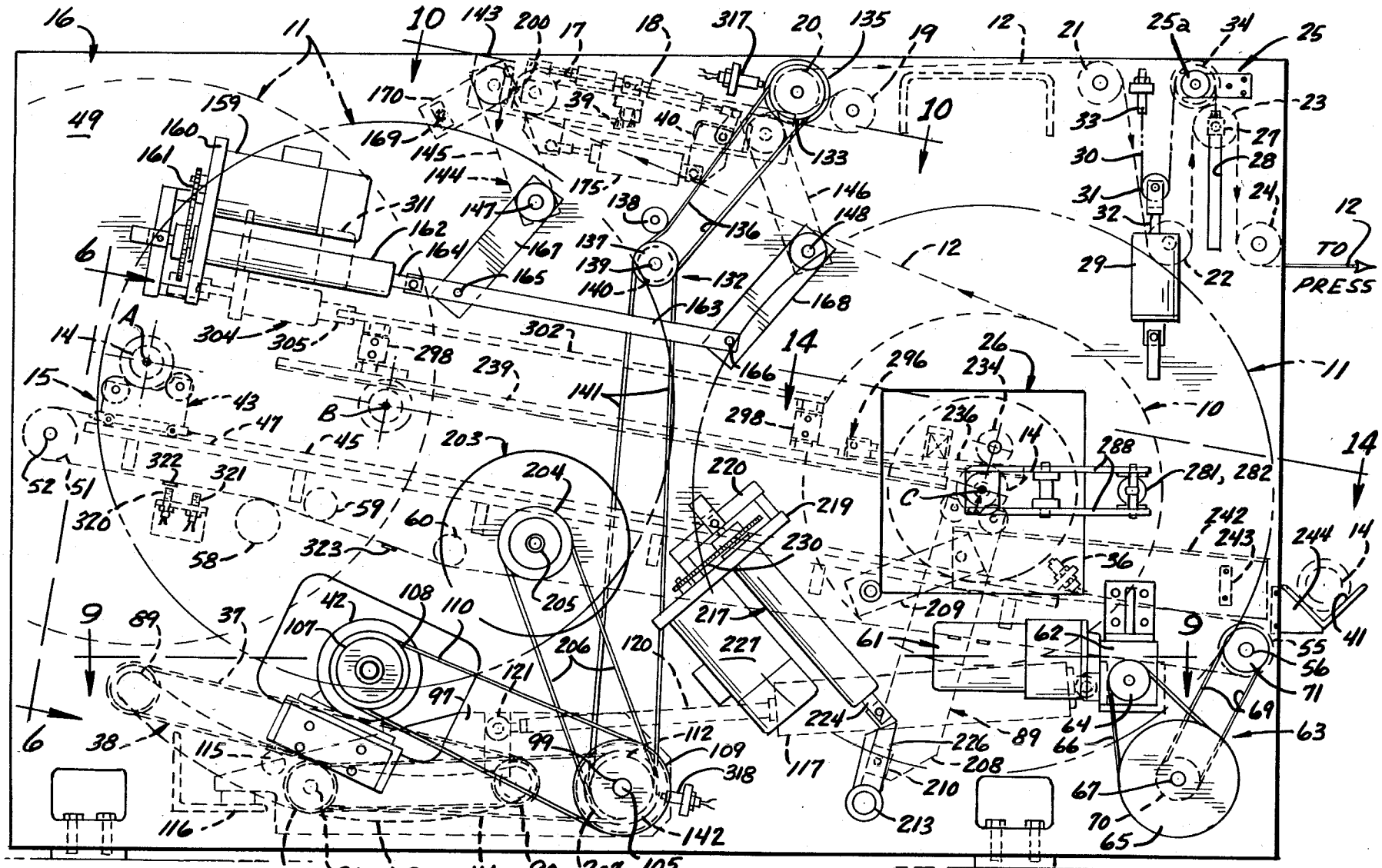
FIG. 2 is a side view of the apparatus.

To support each roll 11 for advancement from the station A to the stations B and C and for rotation while at the station B, the carrier 15 is a conveyor and includes alined cars 43 and 44 (FIGS. 6, 7 and 8) carried respectively by spaced parallel endless chains 45 and 46, the chain 45 and the car 43 being on the near or operator side of the apparatus as viewed in FIG. 2 and the chain 46 and the car 44 being on the far or press side. Each of the chains is disposed in a vertical plane and extends from a point near the front of the frame 16 to a point at the rear adjacent the trough 41. The upper or active run of each chain is inclined slightly downward from front to rear and overlies a stationary rail 47, the rails being welded to brackets 48 projecting inwardly from the side walls 49 and 50 of the frame. At their forward ends, each of the chains extends around a sprocket wheel 51 which is fast on a stub shaft 52 journaled in bushings 53 and 54, the latter being secured by screws to the opposite sides of the adjacent side wall of the frame. The rear ends of the chains are trained around a second pair of sprocket wheels 55 keyed to a horizontal transverse shaft 56 which is journaled in bearings 57 also fastened to the side walls 49 and 50 by screws. The lower run of each chain passes over an idler sprocket wheel 58, under idler sprocket wheels 59 and 60, the sprocket wheel 59 being mounted for vertical adjustment to set the tension of the chain (see FIG. 7). The chainss are driven in unison by a reversible motor 61 (FIGS. 2 and 6) which is mounted on the outside of the wall 49 of the frame 16 and which drives the shaft 56 through a right angle speed-reducing gear box 62 and a speed-reducing chain drive 63. The latter includes a small sprocket wheel 64 fast on the output of the gear box and driving a larger sprocket wheel 65 through a chain 66. The sprocket wheel 65 is keyed to a horizontal shaft 67 which is journaled in bushings 68 (FIG. 6) which are secured to the side wall 49 of the frame. Through a second chain 69, a sprocket wheel 70 fast on the shaft 67 turns a sprocket wheel 71 keyed to the shaft 56 to drive the latter and thus advance and retract the conveyor chains 45 and 46 and the cars 43 and 44.

Figure 7:
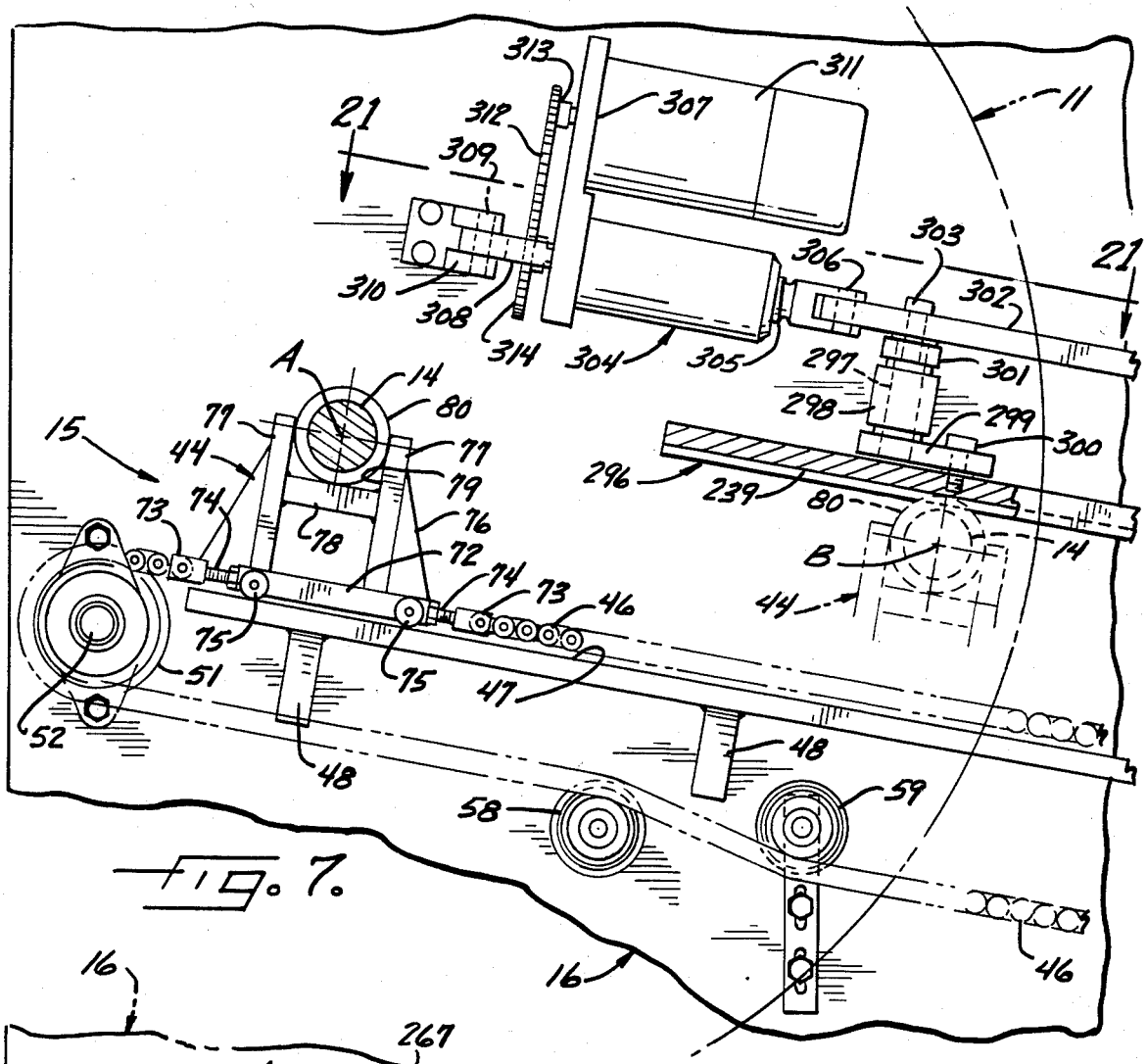
FIG. 7 is a fragmentary sectional view taken along the line 7—7 in FIG. 6.
Figure 8:
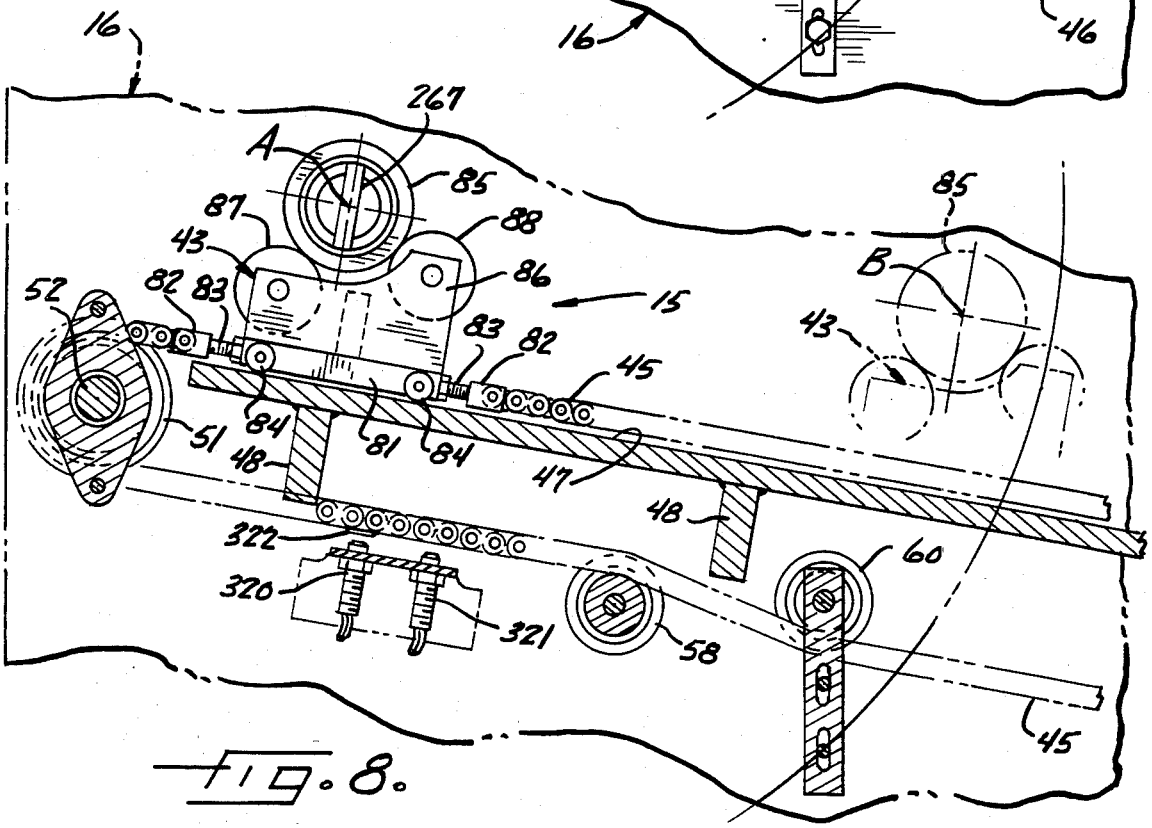
FIG. 8 is a fragmentary sectional view taken along the line 8—8 in FIG. 6.

As shown in FIG. 7, the car 44 on the press side of the apparatus includes a flat base plate 72 disposed between end links 73 of the conveyor chain 46 and secured to these chains by bolts 74 and wheels 75 journaled on the base plate rides on the adjacent rail 47. A bracket 76 upstanding from the base plate and welded to the latter includes spaced generally vertical transverse plates 77 joined by a cross plate 78 to define an upwardly opening pocket 79 for receiving a ball bearing 80 which surrounds the adjacent end of the core 14. The other car 45 on the operator side similarly includes a base plate 81 (FIG. 8) secured to end links 82 of the chain 45 by bolts 83 and carrying wheels 84 which ride on the other rail 47. As will be explained later in more detail, the end of the core 14 on the operator side carries a hub 85 which is used to connect the core to the core brake 26 and the car 43 receives this hub. For this purpose, this car includes laterally spaced plates 86 upstanding from and welded to the base plate 81 and two longitudinally spaced rollers 87 and 88 are disposed between and journaled on the plates. Thus, when a roll 11 is loaded at the station A, the hub 85 rests on the rollers 87 and 88 so that this end of the core also is supported for rotation. The roll remains on the cars 43 and 44 and rotates on the latter as it is turned by the accelerator mechanism 38 at the station B but, at the station C, the roll is raised out of the cars by a lift mechanism 89 to permit the cars to be returned to the station A. While at the station C, the roll remains raised and rotates on the lift mechanism as its web is drawn off by the press.

Figure 9:
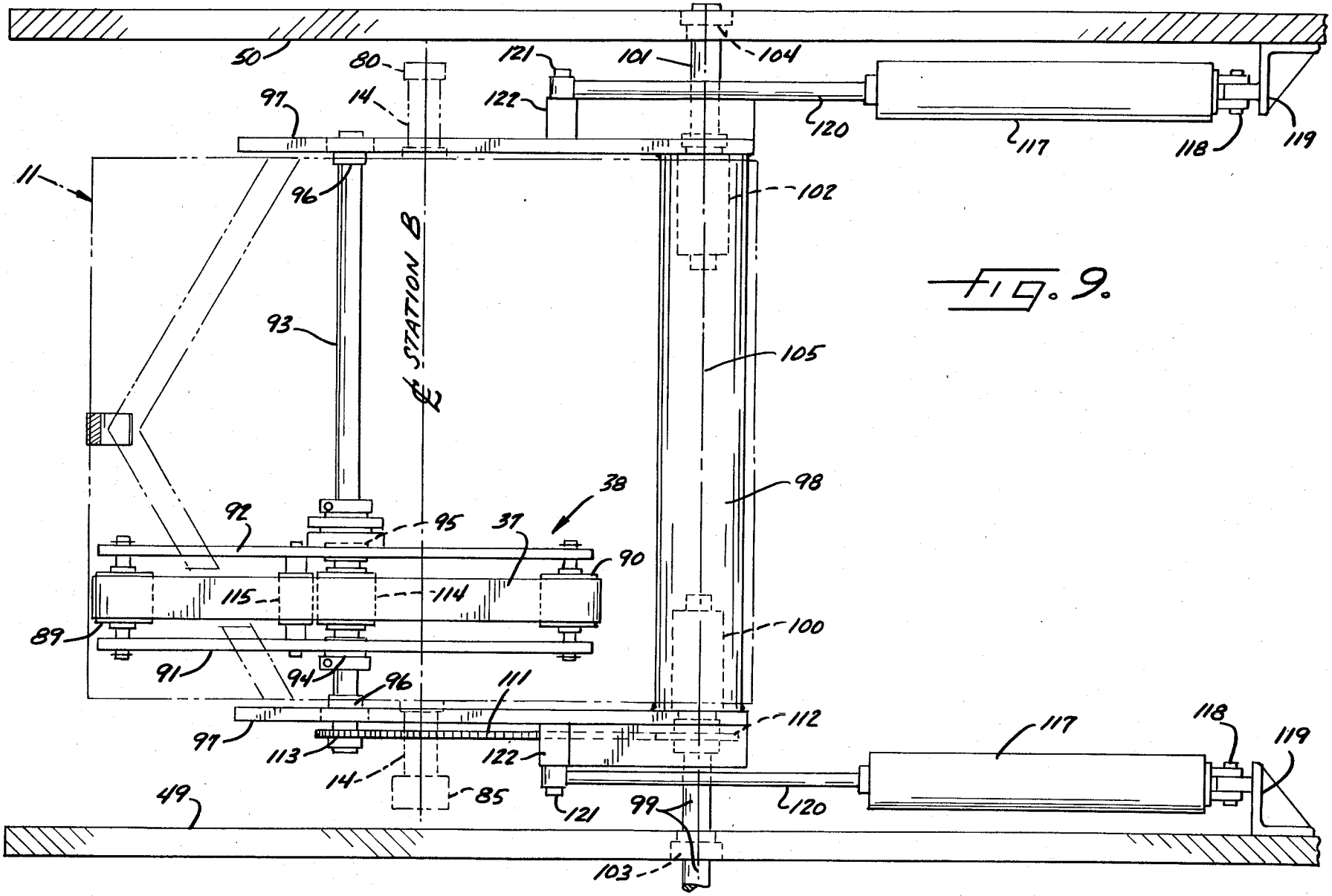
FIG. 9 is an enlarged fragmentary perspective view taken essentially along the line 9—9 in FIG. 2.

In the preferred embodiment, the drive part 37 of the accelerator mechanism 38 is an endless belt over longitudinally spaced horizontal rollers 89 and 90 (FIGS. 2 and 9). The latter are disposed between and journaled on parallel plates 91 and 92 which extend longitudinally of the frame 16 and are beneath a roll 11 at the station B. The plates are mounted on a transverse drive shaft 93 by means of bearings 94 and 95 respectively which permit the shaft to rotate and which are releasably clamped to the shaft to allow lateral adjustment of the positions of the plates and hence of the belt 37 for rolls 11 of different widths. The drive shaft is generally coextensive with the length of the roll and its ends are journaled by means of bearings 96 in arms 97 which are fixed to and project forwardly from the ends of a tubular shaft 98. The latter is supported at the end adjacent the operator side by a coaxial stub shaft 99 the inner end of which projects into a bearing 100 in the end of the tubular shaft. In a similar manner, the end of the tubular shaft adjacent the press side is supported by a second coaxial stub shaft 101 which projects into a bearing 102 in that end of the tubular shaft. The stub shaft 99 also is journaled in the side wall 49 by means of a bearing 103 while the stub shaft 101 is rotatable in a bearing 104 in the side wall 50. As a result, the tubular shaft 98 may turn about its axis 105 to swing the arms 97 together with the shaft 93, the plates 91 and 92 and the belt 37 about this axis. At the same time, the stub shafts are free to rotate independently of the turning of the tubular shaft.

To drive the belt 37, the power actuator 42 is a motor supported on the outside of the frame 16 at the operator side by a bracket 106 bolted to the side wall 49 (see FIG. 2). Through an electromagnetic clutch 107, which is a part of the clutch means referred to above, the motor 42 drives a sheave 108 on the output member of the clutch. A second sheave 109 is keyed to the stub shaft 99 outside the side wall 49 and this sheave is driven by the first sheave through an endless belt 110 to rotate the stub shaft. A toothed belt 111 is entrained around a gear 112 fast on the stub shaft and gear 113 (FIG. 9) on the shaft 93. The drive from the motor to the belt 37 is completed by a roller 114 which is keyed to the shaft 93 and which frictionally engages the inside of the belt, the latter being held in engagement with the roller by an idler roller 115 journaled between the plates 91 and 92.

As the roll 11 is advanced from the station A to the station B, the arms 97 are in their lowermost position as determined by one of the arms abutting a stationary stop 116 (FIG. 2) and, in this condition, the roll clears the belt 37 which is spaced below the roll. Subsequently, the arms 97 are swung up about the axis 105 to bring the belt into frictional driving engagement with the periphery of the roll. For this purpose, two air cylinders 117 are employed with one mounted alongside each of the side walls 49 and 50 rearwardly of the tubular shaft 98. The rear or head ends of the cylinders are attached by means of pivotal connections 118 to stationary brackets 119 welded to the respective side walls of the frame so as to permit limited swinging of the cylinders about transverse axes. The piston rods 120 of the cylinders 117 project forwardly along the outer sides of the arms 97 and are pivotally connected, as indicated at 121, to side flanges 122 on the arms, the pivots 121 being offset from the axis 105. Thus, by retracting and extending the rods 120, the arms 97 and hence the belt 37 may be raised and lowered.

Figure 3:
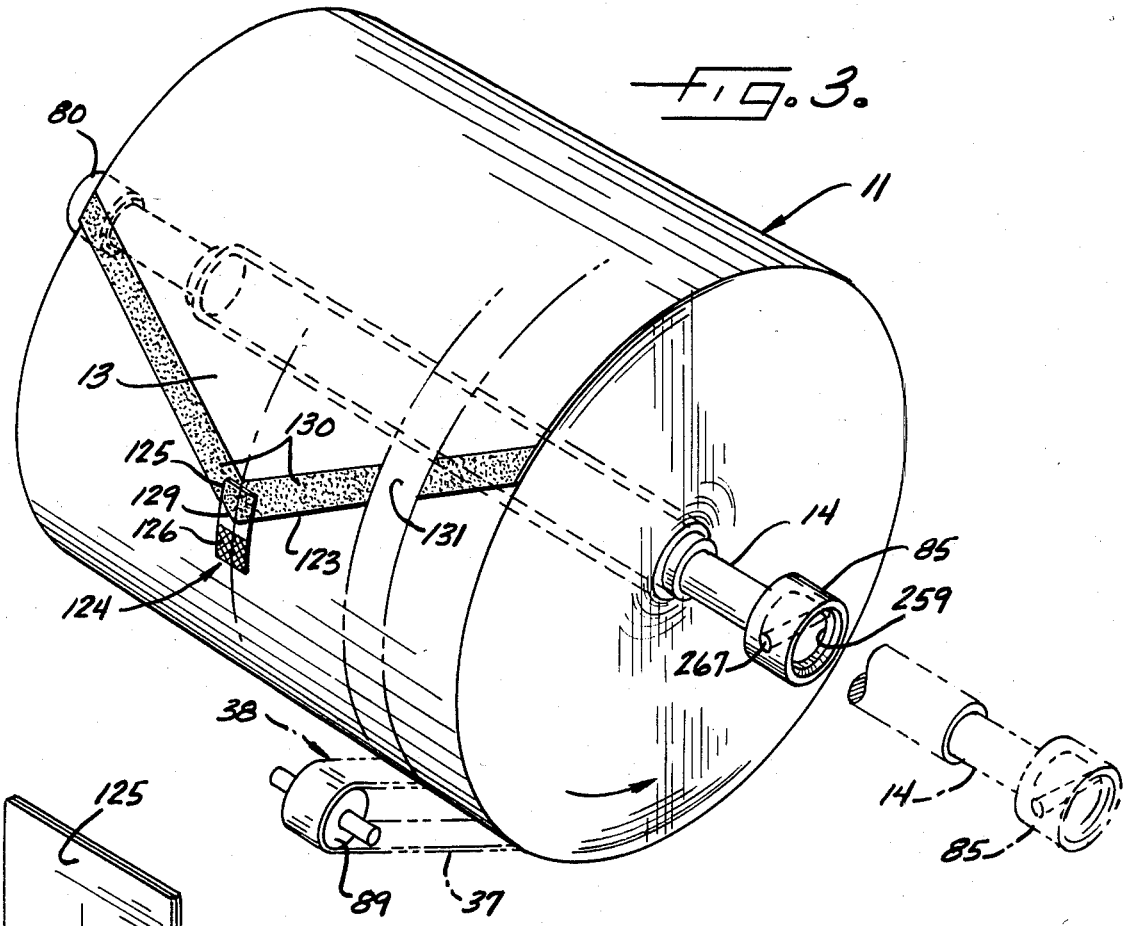
FIG. 3 is a perspective view of the standby roll as prepared for use in the apparatus.
Figure 4:
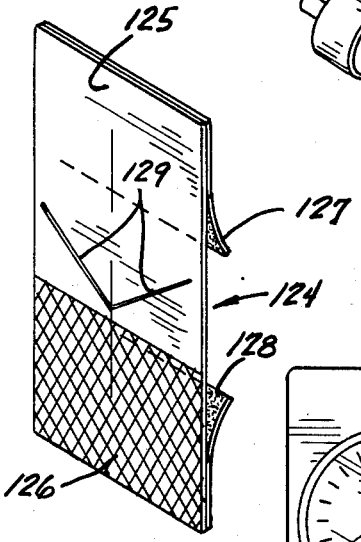
FIG. 4 is an enlarged perspective view of the tab used to hold down the web on the standby roll prior to splicing.

While still at the station A, the new standby roll 11 is prepared for the splice which is to be effected at the station B by the mechanism 18. This preparation includes cutting the free end 123 (FIG. 3) of the web 13 on the roll to give it a V shape and by temporarily securing the apex of the V to the roll by a tag 124. As shown in FIG. 4, the backs of the end portions 125 and 126 of the tag are covered with an adhesive which is protected by paper strips 127 and 128. When the free end 123 has been trimmed to shape, the strips 127 and 128 are removed and the upper end portion 125 of the tag is adhered to the free end while the lower end portion 126 is adhered to the body of the roll. For purposes to be described later, the end portion 126 is darkened to serve as a flag and the center of the tag is weakened by a V-shaped slit 129. In addition, a band 130 of adhesive is applied along the V-shaped end of the web although it is interrupted at 131 so that the drive belt 37 does not engage the adhesive. Herein, a pressure-sensitive adhesive is used.

After the new standby roll 11 has been advanced by the conveyor 15 from the station A to the station B, compressed air is admitted to the rod ends of the cylinder 117 to swing the arms 97 up and raise the drive belt 37 into firm frictional engagement with the roll. Preparatory to splicing the web 13 on the roll 11 to the running web 12 from the roll 10, the motor 42 is energized and the clutch 107 is engaged so that, through the belts 110 and 111, the belt 37 is driven to start turning the roll 11 and accelerating it. Such acceleration continues until the circumferential or peripheral speed of the roll in terms of units of length per unit of time is just short of the linear speed of the web 12 such as, for example, until the peripheral speed reaches 99 percent of the linear speed. Thereafter, a mechanism 132 responsive to the linear speed of the running web further increases the speed of the belt 37 and hence of the roll 11 until the peripheral speed of the roll virtually matches the linear speed of the web. At that time, the apparatus is in condition to splice the web 13 on the roll 11 to the running web 12 from the roll 10.

In order that the mechanism 132 is responsive to the linear speed of the running web 12, the input for this mechanism is a pulley 133 (FIG. 2) which is journaled on the shaft 134 of the idler roller 20 and is driven by this shaft through an electromagnetic clutch 135 so that, when the clutch is engaged, the pulley turns at a speed directly proportional to the linear speed of the web. The clutch 135 together with the clutch 107 constitute the clutch means described earlier. A timing belt 136 trained around the pulley 133 also extends around a pulley 137 and is tensioned by an idler 138 to drive the shaft 139 of the pulley 137. A third pulley 140 on this shaft receives another timing belt 141 which is trained around a pulley 142 on the shaft 99 to complete the alternate drive for the belt 111 of the accelerator mechanism 38. By carefully selecting the sizes of the various pulleys, the mechanism 132 drives the belt 37 at a speed whereby the peripheral speed of the roll 10 closely, or even precisely, matches the linear speed of the web 13.

Figure 10:
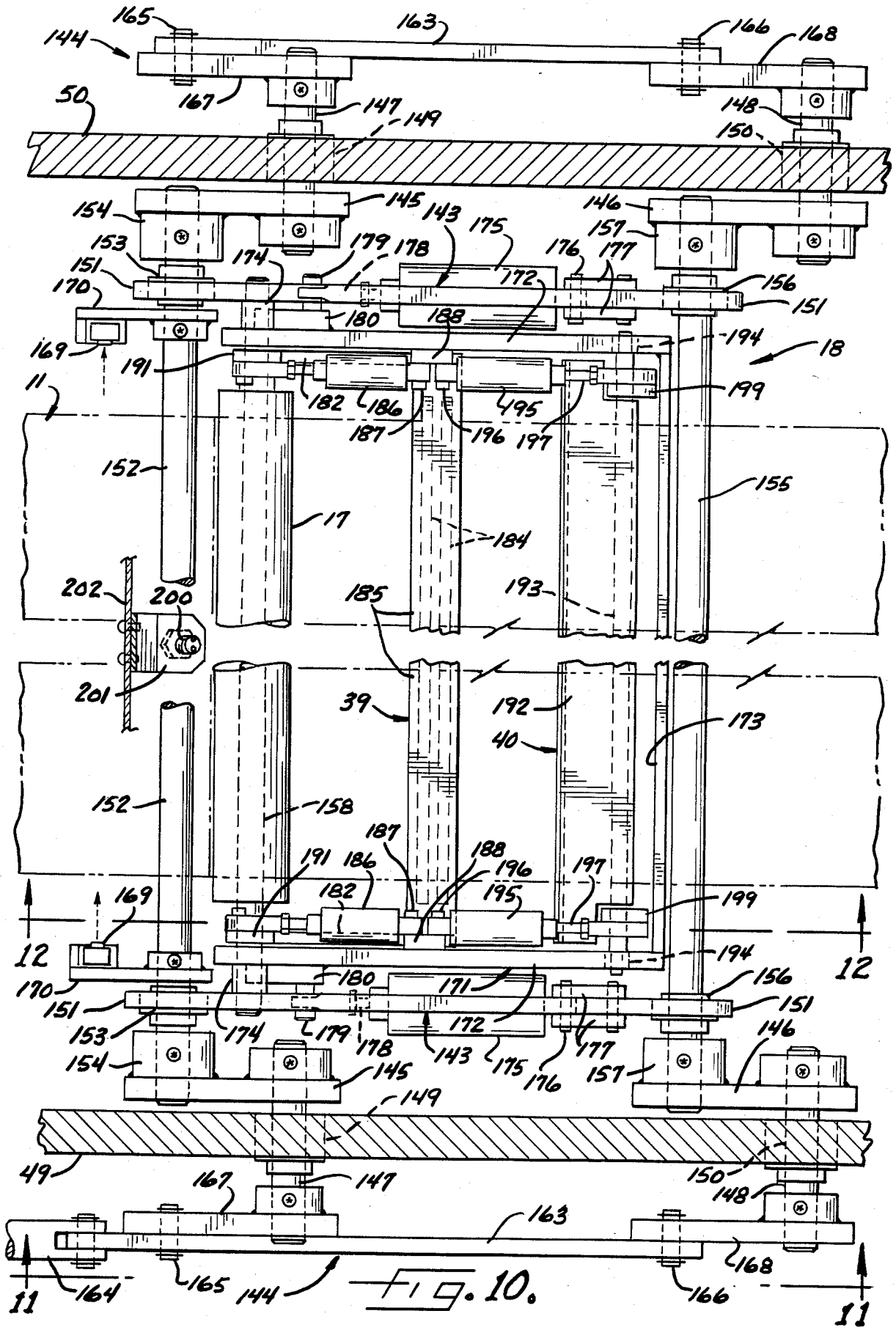
FIG. 10 is an enlarged sectional view taken along the line 10—10 in FIG. 2.

With the standby roll 11 turning so that its peripheral speed matches the linear speed of the running web 12, the splicing mechanism 18 attaches the web 13 on the roll 11 to the running web and then severs the running web from the active roll 10 at the station C. In preparation for this, the splicing mechanism first is lowered from its inactive position (FIG. 2) to an active position closely adjacent the roll 11 (see FIG. 11). For this purpose, the splicing mechanism is mounted on a carriage 143 which, in turn, is supported on the side walls 49 and 50 of the frame 16 by a parallelogram linkage 144. Herein, there are two such linkages, one on the outside of each of the side walls and each including two parallel links 145 and 146 which project upwardly from their respective pivot shafts 147 and 148 (FIG. 10). The latter are journaled in the side walls by means of bearings 149 and 150 and the upper ends of each pair of links are pivotally connected to a cross bar 151. The pivotal connection for the links 145 is formed by a transverse shaft 142 (FIG. 10) journaled in bearings 153 in the cross bars, the ends of the shaft being received in blocks 154 welded to the links. A second shaft 155 similarly journaled in bearings 156 in the cross bars and held in blocks 157 forms the pivotal connection for the links 146. Thus, by swinging the links, the carriage 143, as constituted by the cross bars 151 and the shafts 152 and 153, moves toward and away from the standby roll without changing its attitude. As shown most clearly in FIG. 10, the idler roller 17 for the running web 12 is journaled on a transverse shaft 158 which spans the cross bars 151 with the ends of the shaft being anchored in the cross bars.

To swing the links 145 and 146 and raise and lower the carriage 143, a reversible motor 159 (FIG. 2) is mounted on a bracket 160 secured to the outer side of the operator side wall 49 and, through a chain drive 161, the motor drives a ball screw linear actuator 162. An extension 163 of the output screw 164 of the actuator is pivotally connected at 165 and 166 to parallel arms 167 and 168 fixed to and projecting downwardly from the shafts 147 and 148 respectively. Thus, when the ball screw is driven by the motor, the arms 167 and 168 turn the shafts 147 and 148 which thereby swing the links 145 and 146 and lower the carriage 143. The carriage is lowered to a point where the brush 39 and the knife 40 are in the proper position relative to the roll 11 to make the splice. Because the diameter of the standby roll may vary somewhat from roll to roll, the amount of swinging of the links 145 and 146 is under the direction of sensors 169 (FIGS. 10 through 13) mounted on the carriage and controlling the energization of the motor 159. Herein, the sensors are two opposing photoelectric cells which are secured to the lower ends of arms 170 which project downwardly and forwardly from the shaft 152 and are fixed to the latter to straddle the roll 11 when the carriage 143 is lowered. As the photoelectric cells 169 become level with the edge of the roll as shown in FIG. 12, they sense this condition and stop the motor 159.

The brush 39 and the knife 40 used in splicing are supported in a frame 171 (FIG. 10) which is mounted on the carriage 143 for bodily movement with the latter and also for movement toward and away from the standby roll 11 independently of the carriage. The frame is made up of two spaced parallel side plates 172 extending along the insides of the cross bars 151 of the carriage 143 with a bar 173 spanning the rear ends of the side plates and welded to the latter. At their forward ends, the side plates straddle the idler roller 17 and are journaled on the shaft 148 by means of bearings 174. On each side of the frame is an air cylinder 175 the head end of which is pivotally connected at 176 to a bracket 177 bolted to and depending from the adjacent one of the cross bars 172. The piston rod 178 of each cylinder is pivotally connected as indicated at 179 to a crank arm 180 which depends from and is bolted to adjacent side plate adjacent the forward end thereof. Thus, when compressed air is admitted to the head end of the cylinder, the frame 171 swings down about the axis of the shaft 18 as shown in phantom in FIG. 11 (see also FIG. 12). When the carriage 143 is in its lower position and the frame 171 has been swung down, the bar 173 engages the running web 12 and deflects the latter downwardly preparatory to contact with the roll 11 as illustrated in phantom in FIG. 11 and, to facilitate this, a strip 181 of plastic material may be adhered to the underside of the bar to prevent undue rubbing between the bar and the web.

As the frame 171 swings down, the brush 39 is carried bodily with the frame but initially the brush still is out of contact with the running web 12. To bring the brush down into engagement with this web and to press the latter against the web 13 on the standby roll 11 for pasting the two webs together, the brush also is movable relative to the frame. For this purpose, the brush is mounted on two arms 182 (see FIG. 10) which, in their inactive position, extend along the inside of the side plates 172 of the frame and are pivotally supported at their forward ends on the shaft 158 to swing about the axis of the latter. Herein, the brush is made up of two transverse rows of bristles 184 projecting downwardly from a bar 185 which spans the free ends of the arms 182 and is secured to the latter. Two air cylinders 186 extend along the insides of the side plates above the arms and, as indicated at 187, the head ends of the cylinders are pivotally connected to brackets 188 on the side plates 172. The rods 189 of the cylinders are connected by pivotal 190 to crank arms 191 upstanding from the arms 182 adjacent the shaft 158 so that, when compressed air is admitted to the rod ends of the cylinders, the brush is swung down into engagement with the running web as illustrated in FIG. 12.

Like the brush 39, the knife 40 also is movable both bodily with and relative to the frame 171 so that the knife is in a ready position as the brush effects a paste between the two webs 12 and 13 and then is swung down to sever the web 12 from the roll 10. Thus, the knife is an elongated blade extending transversely fo the frame 171 with the lower edge of the blade being sharpened. The blade is fastened to one leg of an angle bar 192 which also extends transversely of the frame and is welded to the top of a square transverse rod 193, the ends of the rods being journaled in bearings 194 in the side plates 172 of the frame 171 (see FIG. 10). The head ends of cylinders 195 are pivotally mounted at 196 on the brackets 188 and project rearwardly where the ends of their rods 197 are pivotally connected as indicated at 198 (FIG. 12) to the upper ends of crank arms 199 which project upwardly from the square rod 193. With this arrangement, compressed air is admitted to the rod ends of the cylinders 195 to swing the crank arms 199 counterclockwise as viewed in FIG. 13 whereby the blade 40 is snapped down and cuts the web 12.

A splicing cycle is initiated when the diameter of the active roll 10 reaches a preselected diameter, such as one-quarter inch greater than the diameter at which the splice is to be made. At this time, the motor 159 is energized and, through the ball screw 162 and the linkage 144, lowers the carriage 143 until the photoelectric cells 169 sense the periphery of the standby roll 11. Then, compressed air is admitted to the head ends of the cylinders 175 which swing the frame 171 down until the frame assumes the position illustrated in broken lines in FIG. 11 with the bar 173 engaging and deflecting the running web 12 and a sensor 200 in the form of a photoelectric cell on the frame is closely adjacent the periphery of the standby roll where it detects the passing of the flag 126 on the tab 124. The photoelectric cell is secured to a bracket 201 which is fastened to an angle bar 202 spanning the cross bars 151 of the carriage. When the standby roll has turned about one-half a revolution after the flag has been sensed, compressed air is admitted to the rod ends of the cylinders 186 to swing the brush 39 down and press the running web 12 against the web 13 on the standby roll as shown in FIG. 12. As the strip 130 of adhesive passes under the brush, the two webs adhere to each other and the end of the new web is lifted off the standby roll by the running web, this being permitted by the tab tearing at the slit 129. As the flag 126, which had remained on the periphery of the standby roll, passes under the photoelectric cell 200 for the second time, compressed air is admitted to the rod ends of the cylinders 195 and the knife 40 cuts the running web from the roll 10 (see FIG. 13). Simultaneously, the core brake 26 is brought to full energization to stop the core 14 of the exhausted roll 10. The running web thus draws the web 13 to press and the latter web becomes the new running web. The frame 171, the brush 39 and the knife 40 then are returned to their starting positions by admitting compressed air to the other ends of the cylinders 175, 186 and 195, and the motor 159 raises the carriage 143 back to the inactive position.

With the web 13 being drawn from the standby roll 11, the latter becomes the new active roll and is ready to be transferred to the station C. In accordance with an important aspect of the present invention, a novel arrangement is employed to acquire control of the web from the standby roll as this web becomes the running web and to maintain control until the core brake 26 takes over at the station C. To these ends, a brake 203 (FIG. 2) is associated with the drive member or belt 37 of the accelerator mechanism 38 to apply a running tension to the web as the splice is complted and the drive member moves with the roll and maintains the tension until the roll reaches the station C and control of the tension is transferred to the core brake. Herein, this is achieved by connecting the brake 203 to the drive of the belt 37 and by swinging the belt to keep it in engagement with the roll 11 as the latter is moved from the station B to the station C. During this transfer, therefore, the belt is no longer a drive member but, rather, it is a means by which the belt brake 203 applies tension to the new roll. When the latter is positioned at the station C, control of the tension is transferred from the belt brake to the core brake.

In the present instance, the belt brake 203 is an electromagnetic brake mounted outside the frame 16 on the side wall 49 and the rotatable element of the brake carries a pulley 204 (FIG. 2) which turns about the axis 205 of the brake. A belt 206 is trained around this pulley and also around a pulley 207 keyed to the shaft 99. Thus, when the roll 11 is being turned by virtue of the web 13 being drawn off by the press, the clutch 107 is essentially disengaged and the belt 37 is now driven by the roll. At the same time, the brake 203 operates through the belts 206 and 111 to apply a retarding force to the belt 37 which transmits this force to the periphery of the roll 11 to maintain the tension of the web 13. The dancer 25 now controls the energization of the belt brake in essentially the same manner as it had previously controlled the energization of the core brake. Preferably the clutch 107 continues to be energized a small amount so that the motor 42 overcomes the drag in the belt system.

To keep the belt 37 in engagement with the roll 11 as the latter is moved by the conveyor 15 to the station C, the compressed air admitted to the rod ends of the cylinders 117 continues to urge the arms 97 to swing upwardly about the axis 105. Thus, the belt follows the roll and swings from the position shown in phantom in FIG. 1*d* to the position shown in full lines. The belt brake 203, however, is stationary during this swinging but maintains control of the belt 37 through the belt 206 and the pulleys 205 and 207.

When the roll 11 reaches the station C, it is turning in the cars 43 and 44 and is under the tension control of the belt brake 203. While still under the control of the belt brake, the roll is raised out of the cars by the lifting mechanism 89. As shown more in detail in FIGS. 14 through 18, the lifting mechanism includes two parallel upright posts 208 with one disposed just inside of each of the conveyor chains 45 and 46 and with the upper ends of the posts under the end portions of the core 14 of the roll when at the station C. Each post is supported on one of the side walls 49 and 50 for general vertical endwise movement by upper and lower arms 209 and 210. Each arm 209 is fixed to a stub shaft 211 (FIG. 18) which is journaled in a bearing 212 welded to the adjacent side wall and the arms 210 are keyed to a transverse shaft 213 disposed beneath the stub shafts with the ends of the shaft turning in bearings 214 in the side walls 49 and 50. The upper arms are pivotally connected at 215 to the posts near the upper ends of the latter while, as indicated at 216, the lower arms are pivotally connected to the lower ends of the posts so that the arms raise the posts from the lower position illustrated in FIG. 15 to the upper position shown in FIG. 16.

The shaft 213 is turned back and forth by a linear actuator in the form of a ball screw 217 mounted on the outside of the frame 16 on the operator side. The ball screw is inclined downwardly and rearwardly and the upper end of the nut 218 of the ball screw is secured to a plate 219. A parallel plate 220 is clamped to the plate 219 through the medium of spacers 221 and, through a pin 222, is pivoted to a bracket 223 welded to the side wall 49 to support the ball screw for swinging about the axis of the pin. The outer end of the screw 224 is pivotally attached at 225 to the outer end of a crank arm 226 fast on the shaft 213 so that, as permitted by the swinging of the ball screw, the screw 224 is threaded in and out of the nut 218 to raise and lower the posts 208. A reversible motor 227 is secured to the underside of the plate 219 and turns the nut 218 through a sprocket wheel 228 on the output shaft 229 of the motor, a chain 230 and a second sprocket wheel 231 connected to the upper end of the screw.

Two rollers 232 and 233 are journaled side by side on the upper end of each of the posts 208 with the axes of the rollers being in front of and behind the axis of the core 14 of the roll 11 as supported by the cars 43 and 44 at the station C. When the posts are in their lower position, the rollers are spaced beneath the core and, as the posts are raised, the rollers lift the core off the conveyor cars. In this way, the rotational support of the roll is transferred from the bearing 80 at one end of the core and from the rollers 87 and 88 on the car 43 at the other end to the rollers 232 and 233 on the posts (see FIG. 16). When the posts are in the raised position, the end of the core adjacent the operator side is held down in the rollers 232 and 233 by a roller 234 (FIG. 18) which engages the top of the hub 85 on the core and which is journaled on a stub shaft 235 mounted on the inside of the side wall 49. At the other end, the core is held down by a longitudinally extending channel bar 236 which, for a purpose to be described later, is carried by an arm 237 pivotally mounted by a pin 238 (FIG. 22) on a member 239. The arm swings up and down and is urged downwardly by a compression spring 240 acting between the arm and an inverted U-shaped bracket 241 welded to the member 239 and the bearing 80 is disposed in the channel bar.

Figure 14:
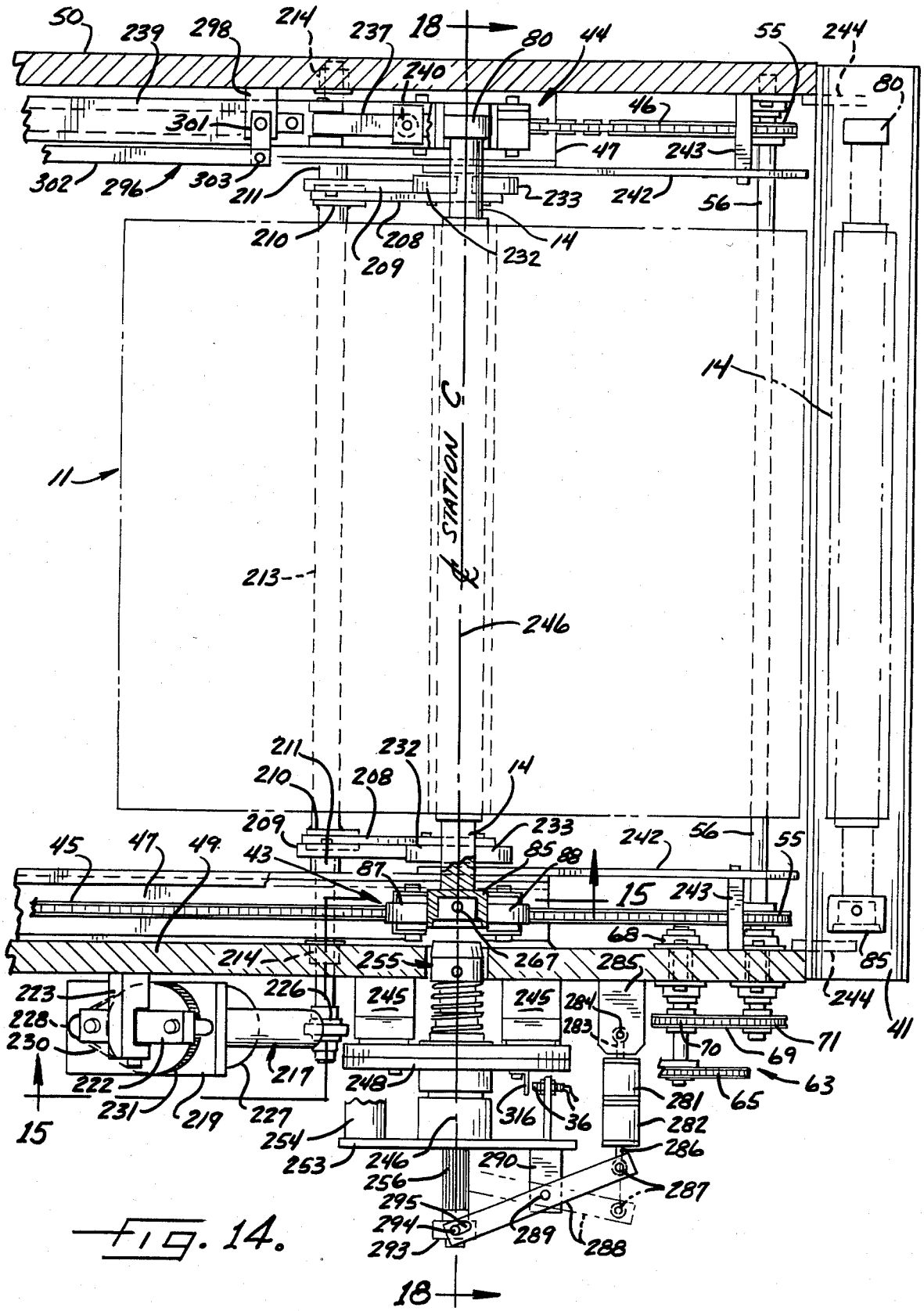
FIG. 14 is an enlarged fragmentary sectional view taken along the line 14—14 in FIG. 2.
Figures 15, 16, 17:
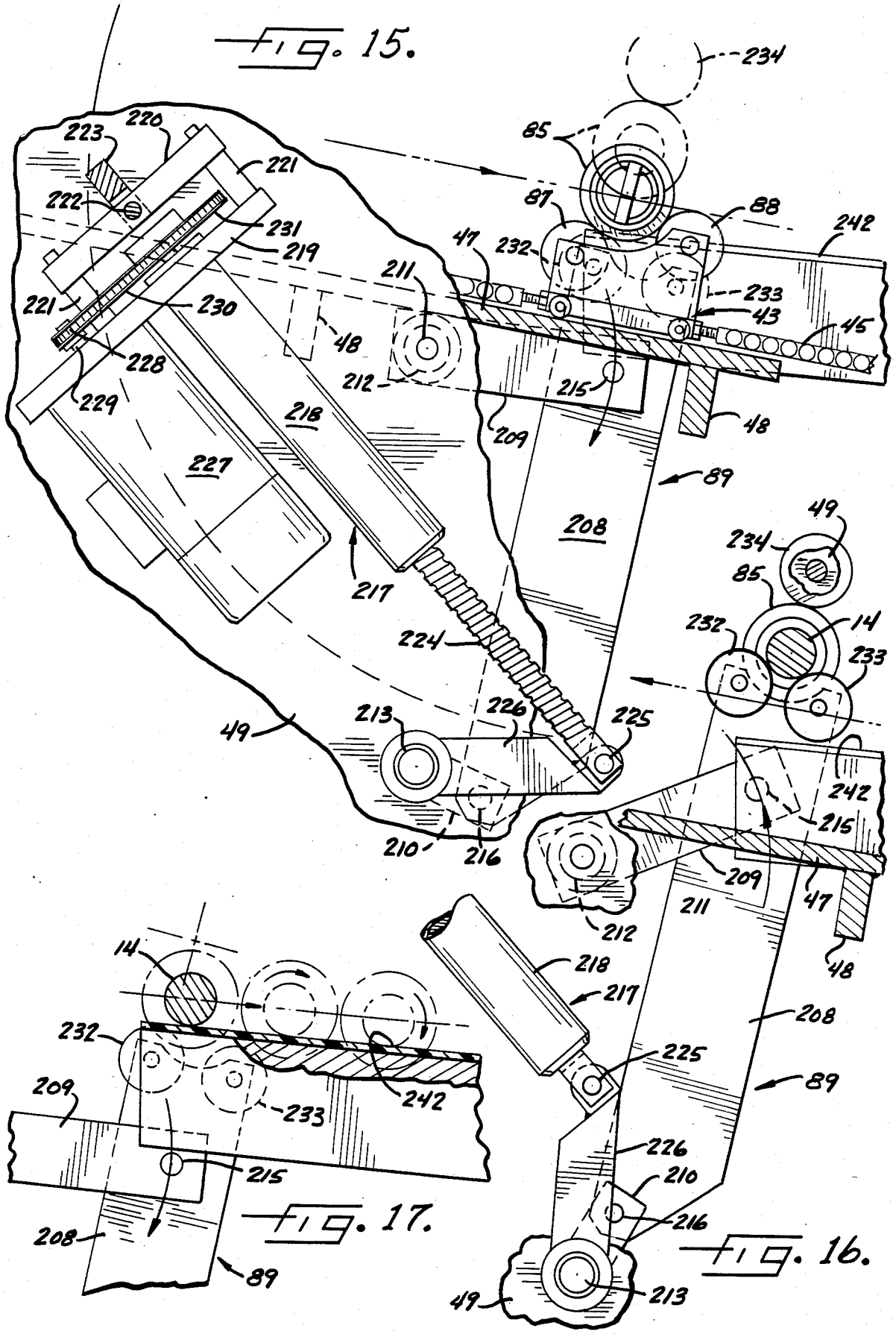
FIG. 15 is an enlarged fragmentary sectional view taken along the line 15—15 in FIG. 14.
FIG. 16 is a view similar to FIG. 15 but showing the parts in a moved position.
FIG. 17 is a view similar to FIG. 16 but showing the parts in a further moved position.

Once it has been lifted off the cars 43 and 44, the roll at the station C remains in the raised position as its web is unwound by the press. After this web is cut from the roll during the next splicing cycle, the posts 208 are lowered and the used core is deposited on a ramp 242 (see FIGS. 15 through 18). The ramp comprises two longitudinal bars, one disposed at each side of the apparatus and each stationarily mounted on the adjacent one of the side walls 49 and 50 by brackets 243 (FIG. 14). The height of the bars is such that the cars carry the core into the station C at a level above the bars 242 and the latter begin at this station and are inclined downwardly toward the trough 41 so that the used core rolls into the trough, the trough being mounted on the ends of the side walls by brackets 244.

As stated earlier, the tension of the web is controlled by the belt brake 203 as the roll 11 is transferred to the station C and, when the roll is fully positioned at this station, the tension control is transferred to the core brake 26. Herein, the latter includes a plurality of coils 245 (FIGS. 14 and 18) secured to the outside of the side wall 49 and are angularly spaced around the axis 246 of the roll as located when the posts 208 hold the roll in the raised position. Friction pads 247 on the ends of the coils constitute the stationary member of the brake and are engaged by a laminated disk 248 which rotates with the roll 11 abou the axis 246 when the core brake is active and which is the rotatable member of the brake. To support the disk for rotation, it is welded to a sleeve 249 which, in turn, is welded to the end flange of a hollow shaft 250 journaled in axially spaced bearings 251. The latter are held in a sleeve 252 bolted to a plate 253 which is perpendicular to the axis 246 and which is mounted on the side wall 49 by means of an angle bar 254.

In a more detailed aspect, the present invention contemplates the provision of a novel means for coupling and uncoupling the disk 248 to the core 14 to transfer the web tension control back and forth between the core brake 26 and the belt brake 203. This means includes a compound clutching assembly 255 which connects a rotating core to the hollow shaft 250 when the latter is stationary without interfering with the rotation of the roll. Thus, the clutching assembly first frictionally connects the core and the shaft to bring the shaft up to the speed of the core and then, when the two are rotating together, effects a mechanical connection.

Herein, the clutching assembly 255 is mounted on the inner end of a splined shaft 256 which extends along the axis 246 and projects through the hollow shaft 250 to slide endwise in the latter while the two shafts turn together. When disconnected fro the core 14, the clutching assembly is in the retracted position illustrated in FIG. 14 and the successive frictional and mechanical connections by the assembly sliding inwardly and coacting with the hub 85 on the core. More specifically, the clutching assembly includes an outer sleeve 257 which frictionally engagaes the hub and an inner sleeve 258 which slides in the outer sleeve to be mechanically connected to the hub. The latter is an outwardly facing cup defining a cylindrical bore 259 of a diameter to receive the inner sleeve and the outer end portion of the cup is counterbored to define an annular shoulder 260 surrounded by an axial flange 261 which has its inner wall 262 flared outwardly. The nose of the outer sleeve is tapered as indicated at 263 to enter inside the flange and a pad 264 of friction material is cemented to the end of the nose to engage the shoulder 260 and produce the frictional connection.

By virtue of diametrically opposed pins 265 (FIGS. 19 and 20) pressed into the outer sleeve 257 and projecting into longitudinal slots 266 in the inner sleeve 258, the latter turns with the outer sleeve but may slide endwise relative thereto. Thus, when the clutching assembly 255 is in the retracted position, the inner sleeve is entirely within the outer sleeve and remains there as the assembly is advanced to bring the pad 264 into frictional engagement with the shoulder 260 in the hub 85. Because of such engagement, rotation of the core 14 is imparted frictionally to the disk 248 of the brake 26 through the outer sleeve and the shafts 256 and 250. To achieve the mechanical connection after the two sleeves are rotating with the core, the inner sleeve is projected out of the outer sleeve and into the bore 259 of the hub 85 where a pin 267 extending diametrically across the bore is received in any two alined notches of four notches 268 formed in the outer end of the inner sleeve. At most, this requires the sleeves and the splined shaft to make no more than a quarter turn relative to the hub and this is aided by inclining the trailing sides 269 of the notches. The other sides 270 of the notches are longitudinal for driving engagement by the pin 267.

Figure 18:
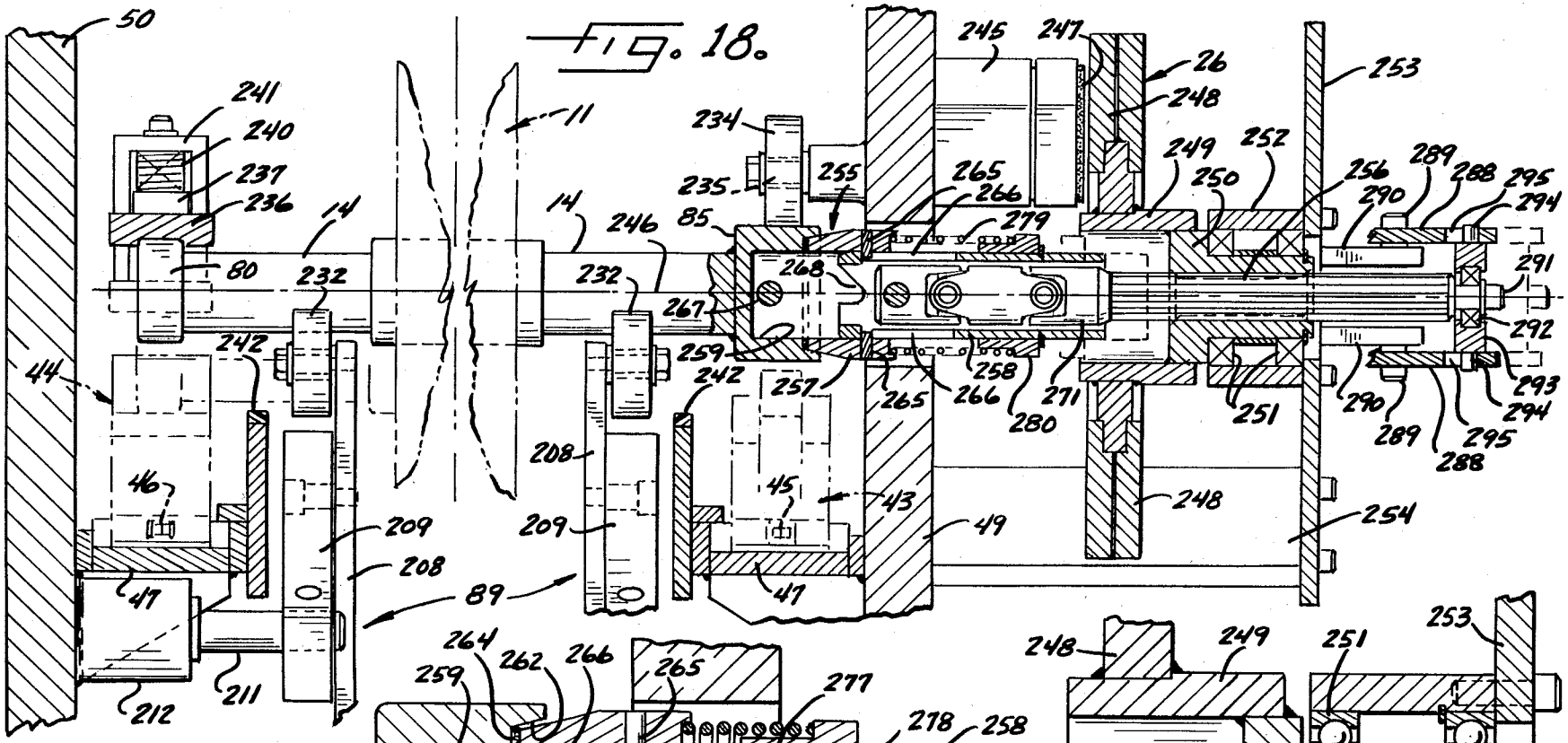
FIG. 18 is a fragmentary sectional view taken along the line 18—18 in FIG. 14 but showing the parts in a moved position.

To support the outer and inner sleeves 257 and 258 on the splined shaft 256 for this compound movement, a cylindrical jaw member 271 is secured to the inner end of the shaft and projects into the outer end of the inner sleeve where it is coupled to a cylindrical spider 272 by a first universal joint 273. A second universal joint 274 couples the spider to a second cylindrical jaw member 275 which pivots in the inner sleeve on a diametrically extending pin 276. The universal joints permit a slight misalignment of the splined shaft and the core 14 while permitting the core to rotate the inner sleeve. Slidable on the inner sleeve and spaced behind the outer sleeve is a third sleeve 277 the outer sliding of which is limited by a snap ring 278 and a compression spring 279 encircles the inner sleeve and acts between a radial flange 280 on the sleeve 277 and the opposing end of the outer sleeve. The spring normally urges the outer sleeve forward on the inner sleeve with the pins 265 abutting the forward end of the slots 266 as illustrated in FIG. 18. In this position, the nose 263 of the outer sleeve projects beyond the inner sleeve so that, when the splined shaft is moved in toward the core 14, the pad 264 engages the shoulder 260 to make the frictional connection. As the advance of the splined shaft is continued, the inner sleeve slides forward as permitted by the spring 279 compressing and the pin 267 is received in a pair of notches 268 to form the mechanical connection.

Figure 19:
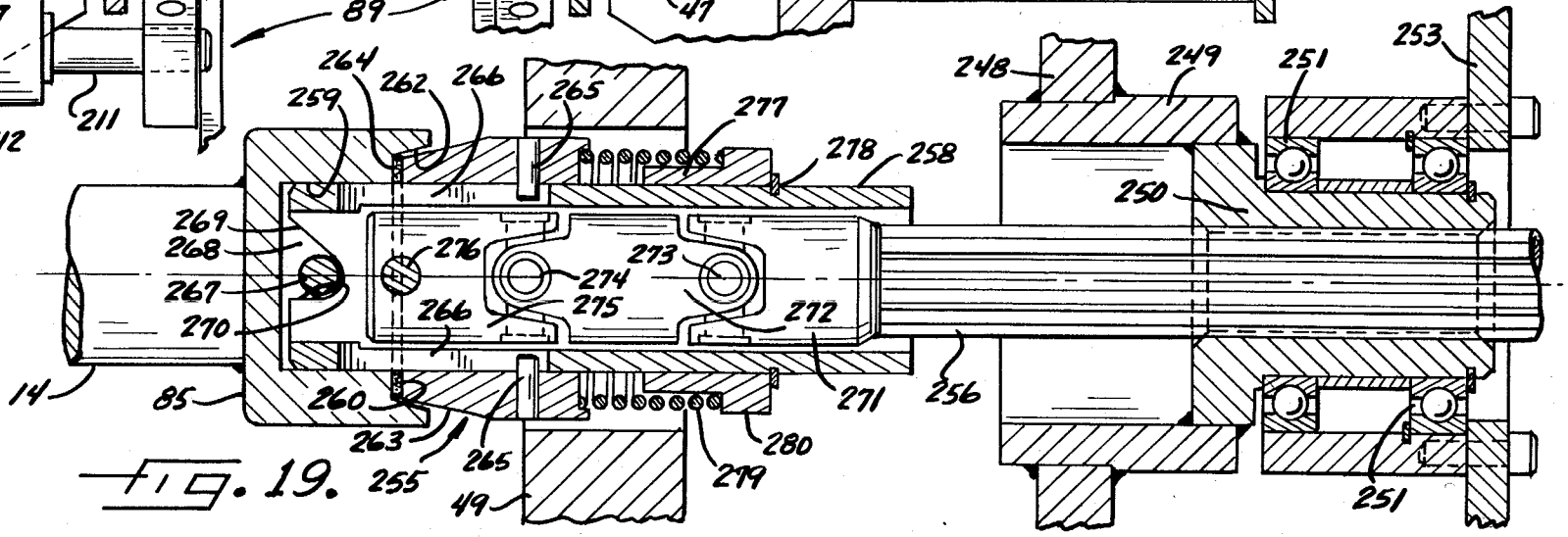
FIG. 19 is an enlarged sectional view similar to FIG. 18 but showing the parts in a further moved position.
Figure 20:
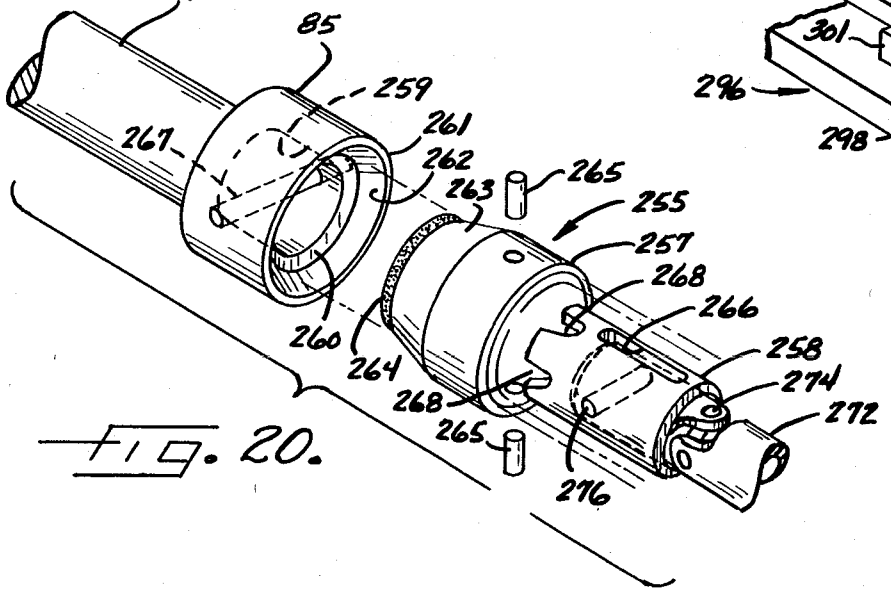
FIG. 20 is a fragmentary exploded perspective view of the clutching assembly used to couple the core of the active roll to the core brake.

The splined shaft 256 is moved axially by two air cylinders 281 and 282 (FIG. 14) arranged in series with the cylinder 281 being effective to bring the outer sleeve 257 into frictional engagement with the hub 85 and the cylinder 282 being subsequently operable to slide the inner sleeve 258 into the mechanical connection with the hub. Thus, the cylinders are axially alined with their head ends attached to each other and the rod 283 of the cylinder 281 is pivotally connected at 284 to a bracket 285 on the outside of the side wall 49. The rod 286 of the other cylinder 282 is connected by a pivot 287 to one end of each of two parallel levers 288 which are fulcrumed intermediate their ends at 289 on brackets 290 fixed to the plate 253 (see also FIG. 18). The outer end portion 291 of the splined shaft is journaled by a bearing 292 in a ring 293 and pins 294 project from opposite sides of the ring and into slots 295 in the levers to pivotally connect the latter to the splined shaft. With this arrangement, compressed air is admitted to the head end of the cylinder 281 and this swings the levers 288 to a position midway between the solid line and broken line positions illustrated in FIG. 14. As a result, the splined shaft is shifted endwise to move the clutching assembly 255 to the position shown in FIG. 18 with the outer sleeve 257 engaging the hub 85 and the inner sleeve 258 retracted within the outer sleeve. The inner sleeve is projected beyond the outer sleeve by admitting compressed air to the head end of the cylinder 282 thereby swinging the levers to the broken line position illustrated in FIG. 14 and moving the inner sleeve into engagement with the hub as illustrated in FIG. 19.

Figure 21:
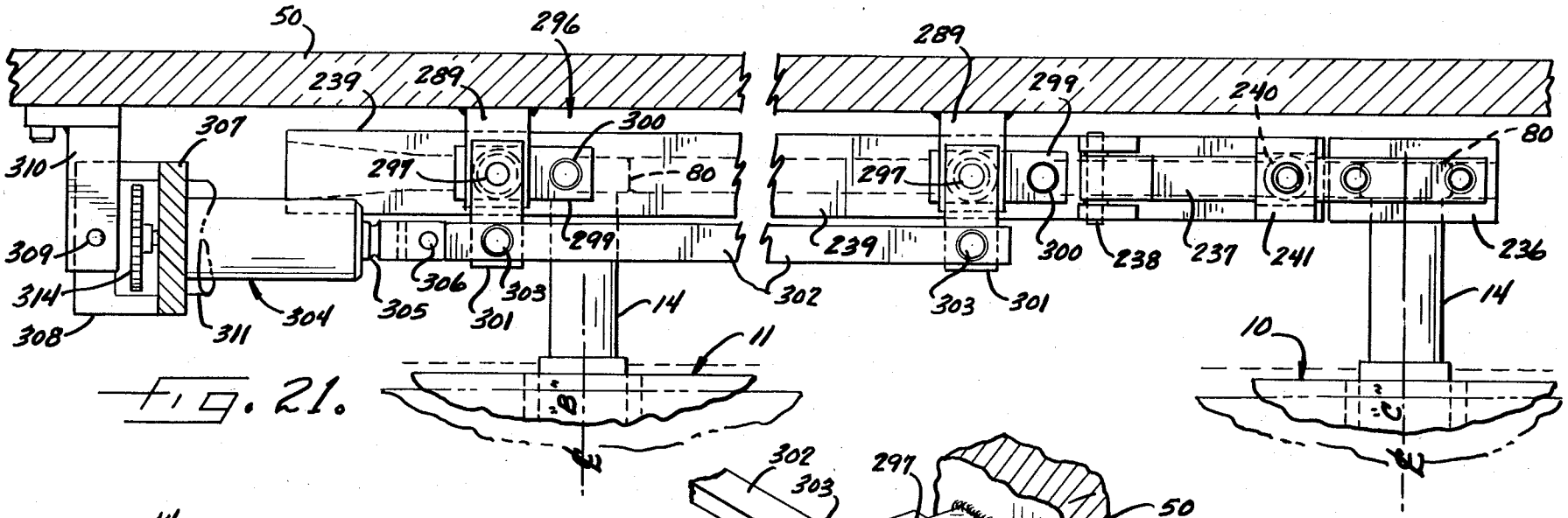
FIG. 21 is an enlarged fragmentary sectional view taken along the line 21—21 in FIG. 7.
Figure 22:
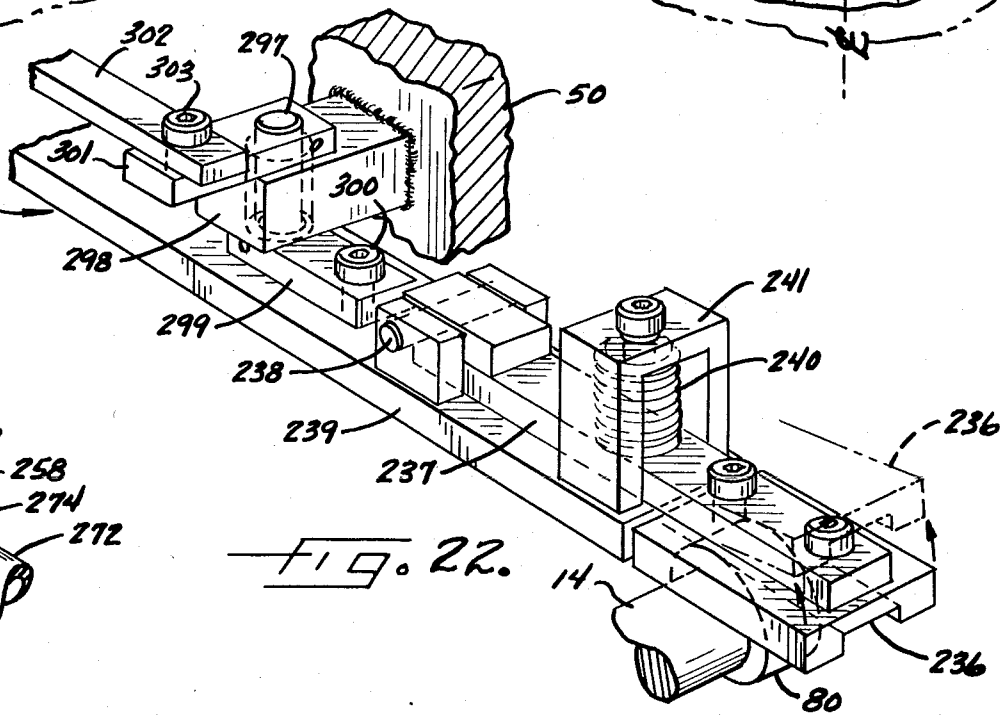
FIG. 22 is a fragmentary perspective view of mechanism used to adjust the lateral position of the running web.

As the standby roll 11 is transferred from the station A to the station B, its lateral position is under the control of what is known in the art as a side lay mechanism 296 shown most clearly in FIGS. 7, 21 and 22. This mechanism includes the member 239 which is an inverted channel disposed above and parallel to the rail 47 associated with the chain 46 and receiving the ball bearing 80 on the press side end of the core 14. The channel 239 is movable sidewise with the ball bearing following the channel to shift the roll while the core remains supported by the cars 43 and 44. For this purpose, a plurality of vertical pins 297 are journaled in individual blocks 298 welded to the side wall 50 and fixed to the lower end of each pin is one end of a horizontal arm 299 the other end of which is connected to the top side of the channel by a pivot 300. The arms are parallel to each other so that they swing together to move the channel laterally. A second set of parallel arms 301 are fast on the upper ends of the pins and are joined by a longitudinally extending bar 302 connected to each arm 301 by a pivot 303. The bar is shifted endwise by a ball screw linear actuator 304 (FIG. 7) the screw 305 of which is pivotally connected at 306 to the bar. The actuator is mounted to pivot slightly to permit some sidewise movement of the bar 302 and, for this purpose, it is fixed to a plate 307 which, through a U-shaped member 308 and a pin 309, is pivoted on a forked bracket 310 bolted to the side wall 50 and a reversible motor 311 is mounted on the bracket alongside the actuator. The motor drives the actuator by means of a chain 312 trained around a sprocket wheel 313 on the output of the motor and a second sprocket wheel 314 on the nut of the actuator. Thus, the screw 305 may be moved in or out to turn the arms 301 and hence the arms 299 thereby to shift the channel 239 in or out such as is shown by the broken line and dashed line positions illustrated in FIG. 21. With this arrangement, the channel bar 236, which is mounted on the channel, serves as a continuation of the latter so that it adjusts the lateral position of the roll at the station C as well as holding the ball bearing 80 down.

Figure 23:
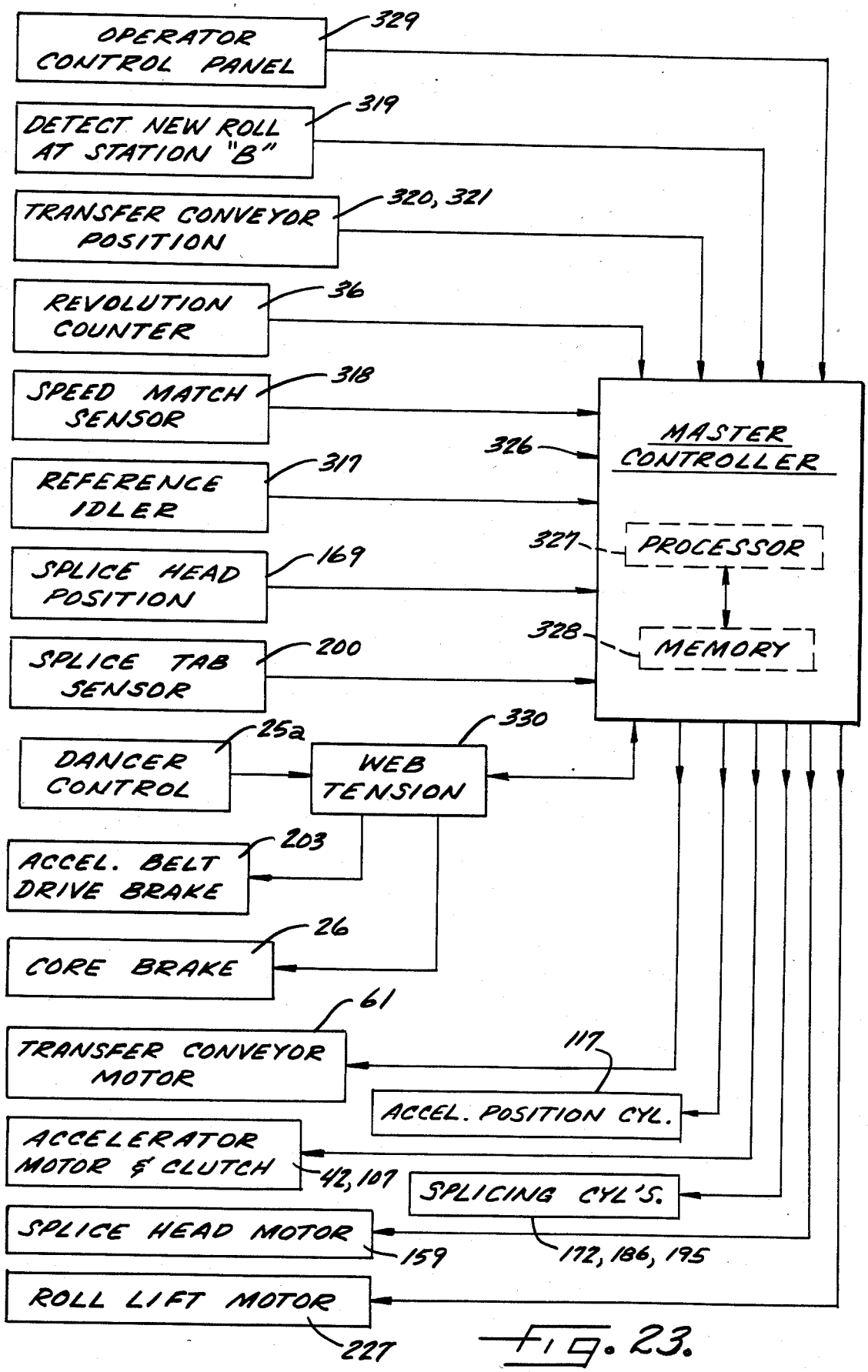
FIG. 23 is a diagrammatic view of the control system for the apparatus.

The apparatus incorporated various sensors, including the sensor 36, which form part of the control systems hown diagrammatically in FIG. 23 and which sense conditions and initiate and control functions. Thus, the sensor 36 is a proximity switch which cooperates with a flag 316 (FIG. 14) on the disk 248 of the core brake 26 to serve as a revolution counter and the revolutions when compared with time provide a signal which is proportional to the speed of rotation of the roll 10 and hence of its diameter. Similarly, a proximity switch 317 (FIG. 2) measures the speed of rotation of the idler roller 20 to provide a signal proportional to the linear speed of the web 12 whereby the idler roller serves as a reference based upon web speed. A third proximity switch 318 is located at the gear 112 to provide a signal proportional to the linear speed of the drive belt 37 and thus to the peripheral speed of the standby roll 11 at the station B. A proximity switch 319 (FIG. 1*b*) disposed at the station B coacts with the core 14 to detect the presence of a standby roll at this station. As stated earlier, the control system further includes the photoelectric cell 169 which is mounted on the splice assembly carriage 143 and which senses the periphery of the standby roll 11 to locate the carriage. Also, the photoelectric cell 200 coacts with the flag 126 on the tab 124 to initiate the operations of the brush 39 and the knife 40.

Figure 6:
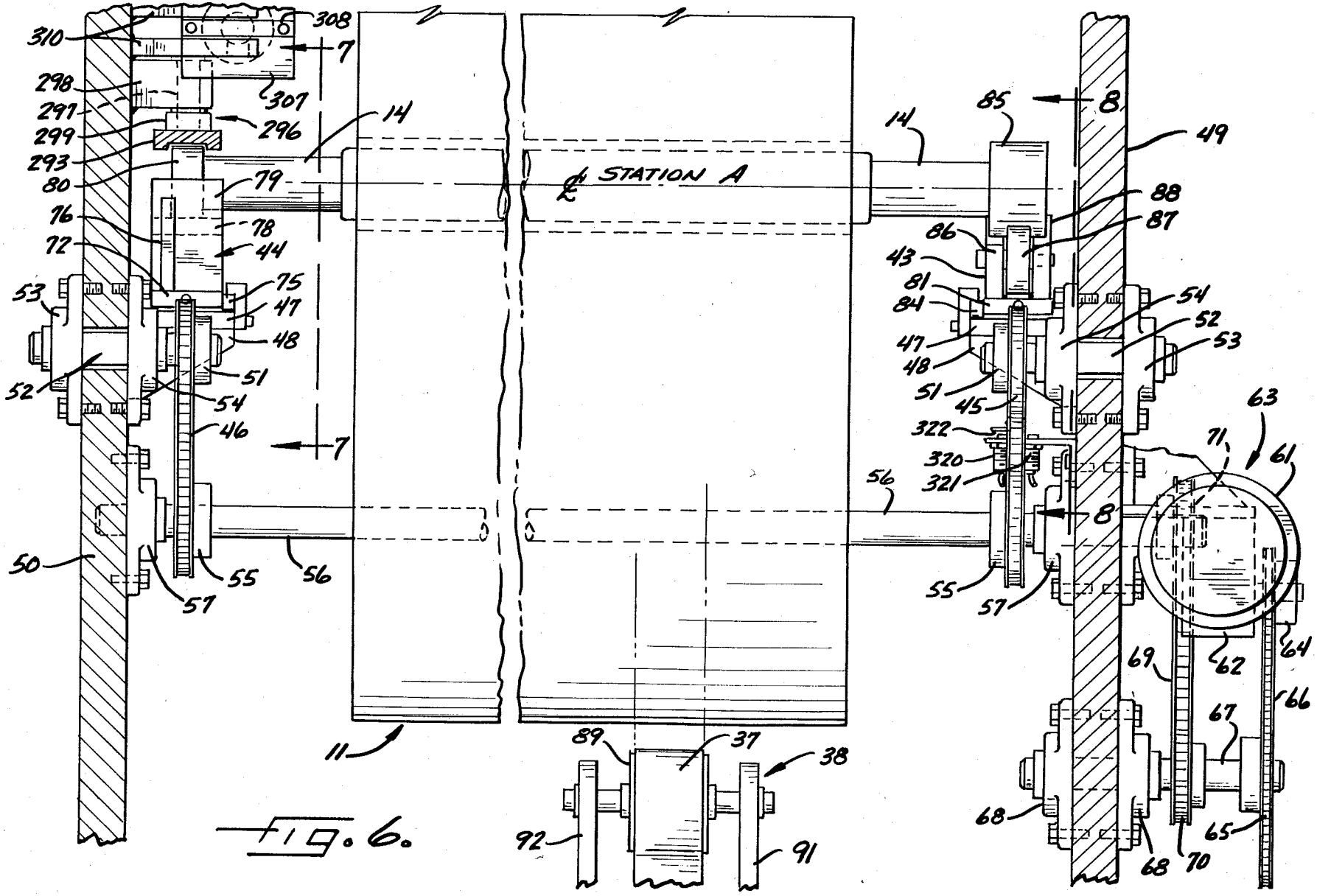
FIG. 6 is an enlarged sectional view taken along the line 6—6 in FIG. 2.

To control the energization of the conveyor motor 61 so as to stop the forward advance of the cars 43 and 44 at the stations A, B and C and then to stop the return of the cars at the station A, two stationary photoelectric cells 320 and 321 (FIGS. 1*a* through 1*d*) are disposed side by side along the conveyor chain 45 (see also FIGS. 2 and 6). These cells coact with a flag 322 on the chain, a flag 323 trailing on the chain and a pair of flags 324 and 325 trailing further on the chain. When the car is at the station A, the flag 322 is alined with the cell 320 while no flag opposes the cell 321 as shown in FIG. 1*a* and this provides a signal which deenergizes the conveyor motor. After the latter is energized to advance the cars, the flag 323 opposes the cell 321 but no flag is in front of the cell 320 when the cars arrive at the station B (FIG. 1*b*) and this combination provides a signal to deenergize the motor. Upon the next advance, the flags 324 and 325 register respectively with the cells 320 and 321 (FIG. 1*d*) to deenergize the motor when the cars reach the station C. When the motor is reversed to return the cars, the flag 323 passes over the cell 321 but no signal is produced until the cars reach the station A at which time the flag 322 opposes the cell 320 to deenergize the motor.

Figure 5:
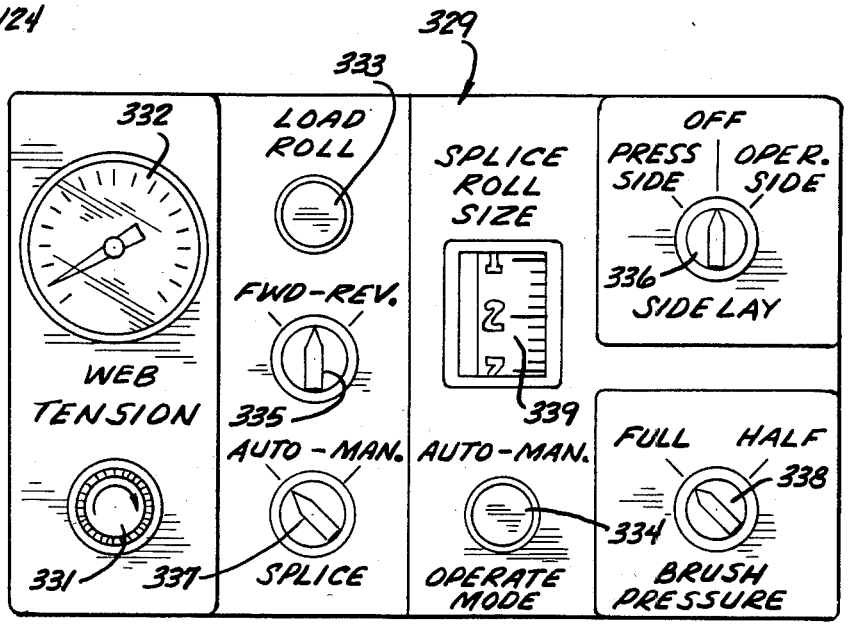
FIG. 5 is a front view of the control panel used with the apparatus.

With reference to FIG. 23, the control system for the apparatus includes a master controller 326 which incorporates appropriate processor and memory components indicated diagrammatically at 327 and 328 respectively and which both receives the signals from the various sensors and issues command signals to the operating elements. The master controller also is responsive to signals inserted manually at an operator control panel 329 (FIG. 5). Thus, the potentiometer 25*a* associated with the dancer 25 is part of a dancer control 25*a* (FIG. 23) which provides a signal to a web tension control 330 and may be set for the desired tension of the web by a knob 331 on the control panel, the tension being indicated on a dial 332. Although all other operations of the apparatus are essentialy automatic, a prepared standby roll 11 is advanced from the station A to the station B upon a manual signal given by the LOAD ROLL push button 333 on the panel. The apparatus may be changed between automotic and manual operation by a push button 334 and, when in the manual mode, the conveyor 15 may be moved forward or back by manual use of a knob 335. The side lay adjustment also is effected manually by a knob 336 which may be used to energize the motor 311 in either direction until the channel 239 is in the desired position. The splicing mechanism 18 may be operated automatically or manually by setting a knob 337 and a knob 338 is used to set the pressure by which the brush 14 is urged against the standby roll 11 during splicing. Finally, the control panel includes a dial 339 which is set manually to select the diameter of the active roll 10 at which it is desired to make a splice.

In operation, if it is assumed that an active roll 10 is at the station C with its web 12 running to the press and that there is no standby roll 11 in the apparatus, the web tension wil have been set by the knob 331 at the control panel 329 and, in response to this, the master controller 326 provides an appropriate signal to the web tension controller 330. The latter provides a command signal, as modified by the potentiometer of the dancer control 25*a*, to the core brake 26. (In FIG. 23, each of the various elements of the control are identified by the same reference character as was used earlier to identify its primary component.) The splice diameter of the roll 10, that is, the final diameter of the roll after a splice has been completed, has been set as, for example, at four inches on the dial 339 on the control panel. The side lay has been adjusted through the knob 336, the push button 334 and the splice knob 337 have been set for automatic operation, and the brush pressure knob 338 is at FULL. Also, the belt 37 is in its lowest position and the cars 43 and 44 are at the station A.

Figure 1B:
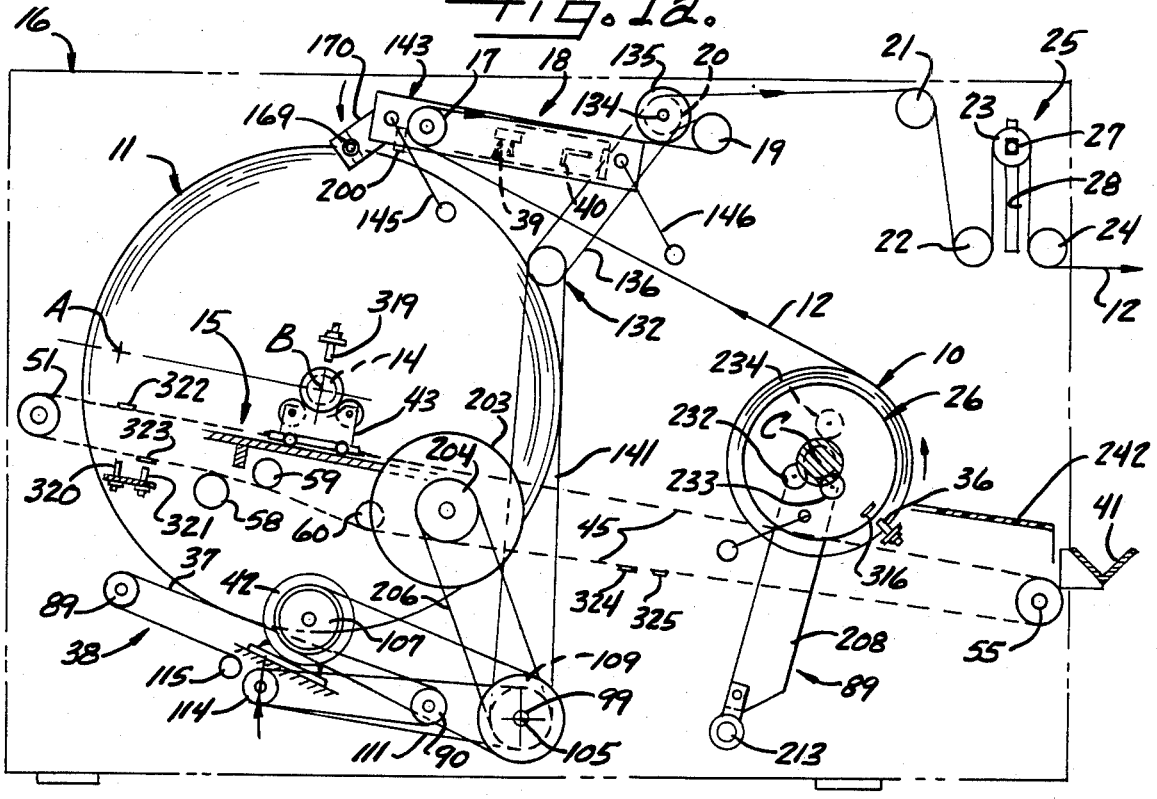
FIG. 1*b* is a view similar to FIG. 1*a* with the parts in a moved position.
Figure 1C:
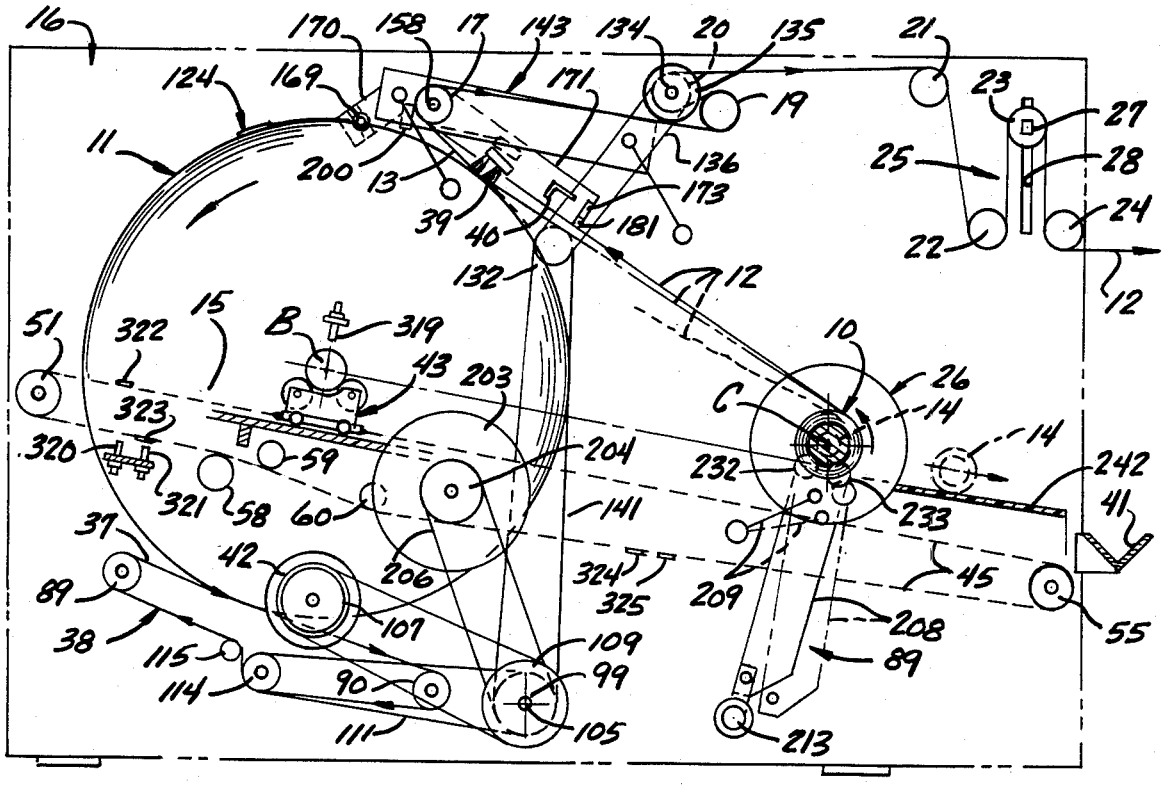
FIG. 1*c* is a view similar to FIG. 1*a* with the parts in a further moved position.

With the apparatus in this condition, a new standby roll 11 is loaded onto the cars 43 and 44 at the station A, the end 123 of the web 13 on the roll is trimmed and taped down by the tab 124 and the adhesive 130 is applied. Then, the LOAD ROLL push button 333 on the control panel 329 is depressed to energize the conveyor motor 61. As a result, while the web 12 continues to be drawn off the active roll 10 at the station C, the chains 45 and 46 of the conveyor 15 advance the cars and the standby roll until the flag 323 is alined with the photelectric cell 321 at which time the roll is at the station B. Signals from the proximity switches 36 and 317 combine to give an indication of the diminishing diameter of the active roll and, when this diameter reaches a preselected size such as 16 inches, compressed air is admitted to the rod end of the cylinder 117 to raise the drive belt 37 up against the underside of the standby roll (FIG. 1*b*). The apparatus continues in this condition until the diameter of the active roll reaches a size at which the splicing operation may begin and be completed without leaving a significant amount of unused web on the roll, the particular diameter depending on the speed of the press. When this diameter is reached, the belt motor 42 is energized and the clutch 107 is gradually engaged to drive the belt 37 which truns and accelerates the standby roll. The proximity switches 317 and 318 together sense the peripheral speed of the standby roll and compare it with the linear speed of the running web 12 so that, when the peripheral speed is at about 99 percent of the linear speed, the master controller 26 energizes the clutch 135 to provide a mechanical drive for the belt 37 from the idler roller 20 through the timing belts 136 and 141 and to bring the peripheral speed of the standby roll up to a virtual match of the linear speed of the running web.

Figure 11:
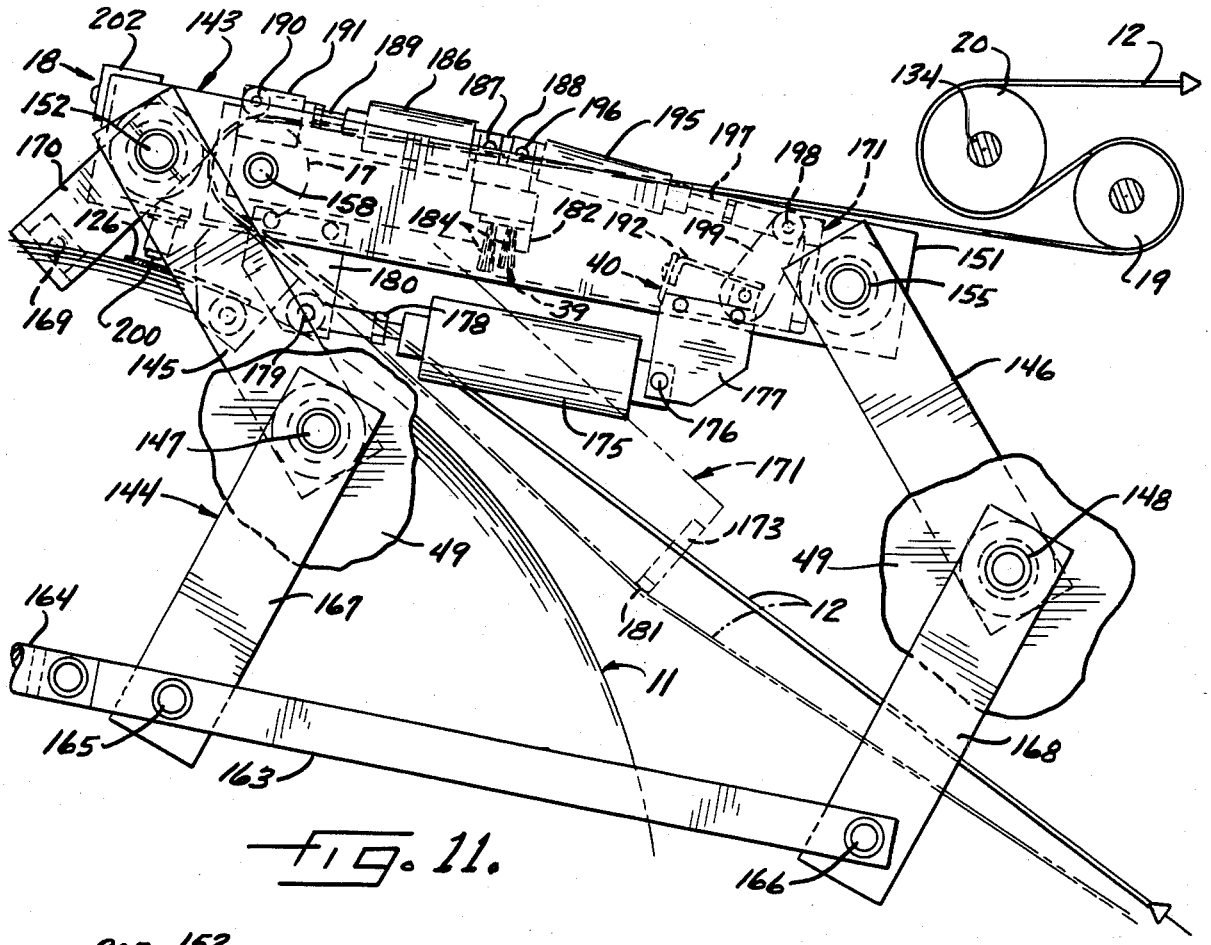
FIG. 11 is a fragmentary sectional view taken along the line 11—11 in FIG. 10.
Figure 12:
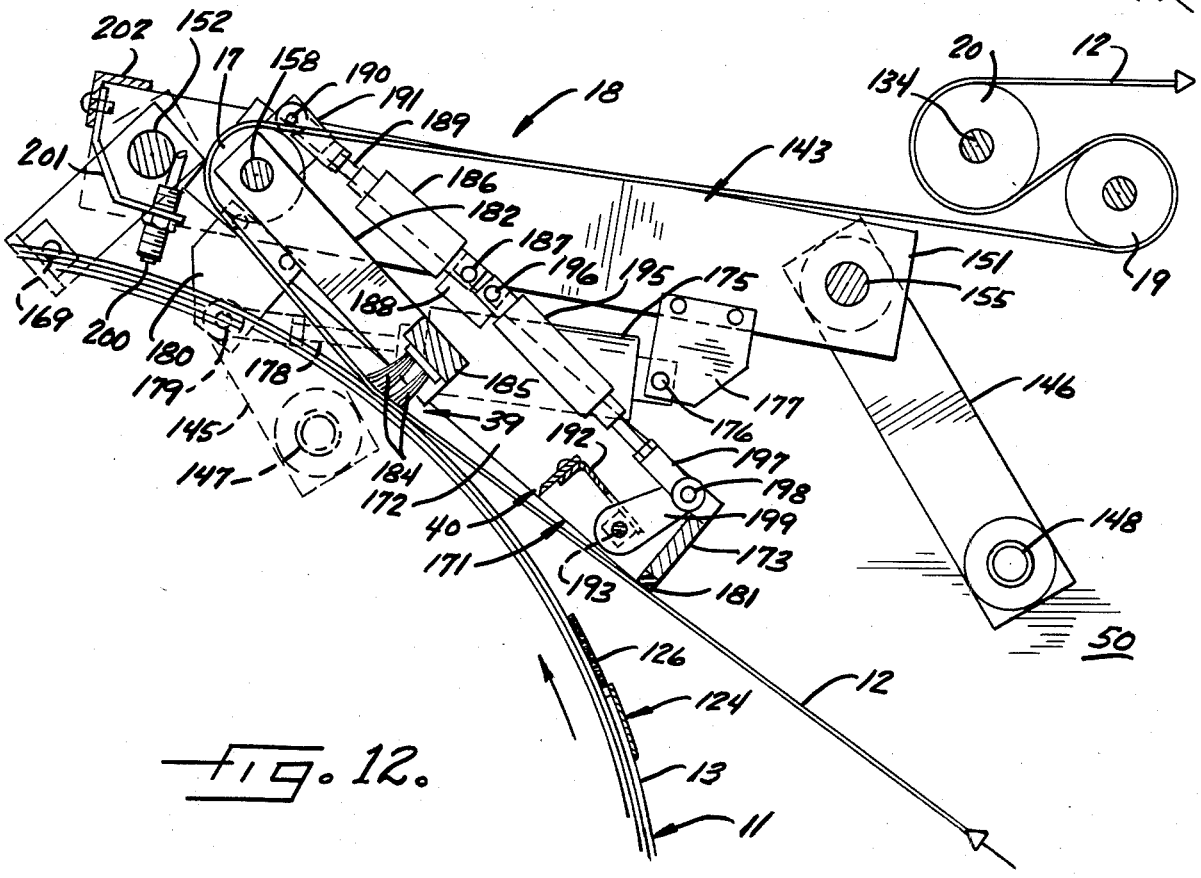
FIG. 12 is a fragmentary sectional view taken along the line 12—12 in FIG. 10 but showing the parts in a moved position.
Figure 13:
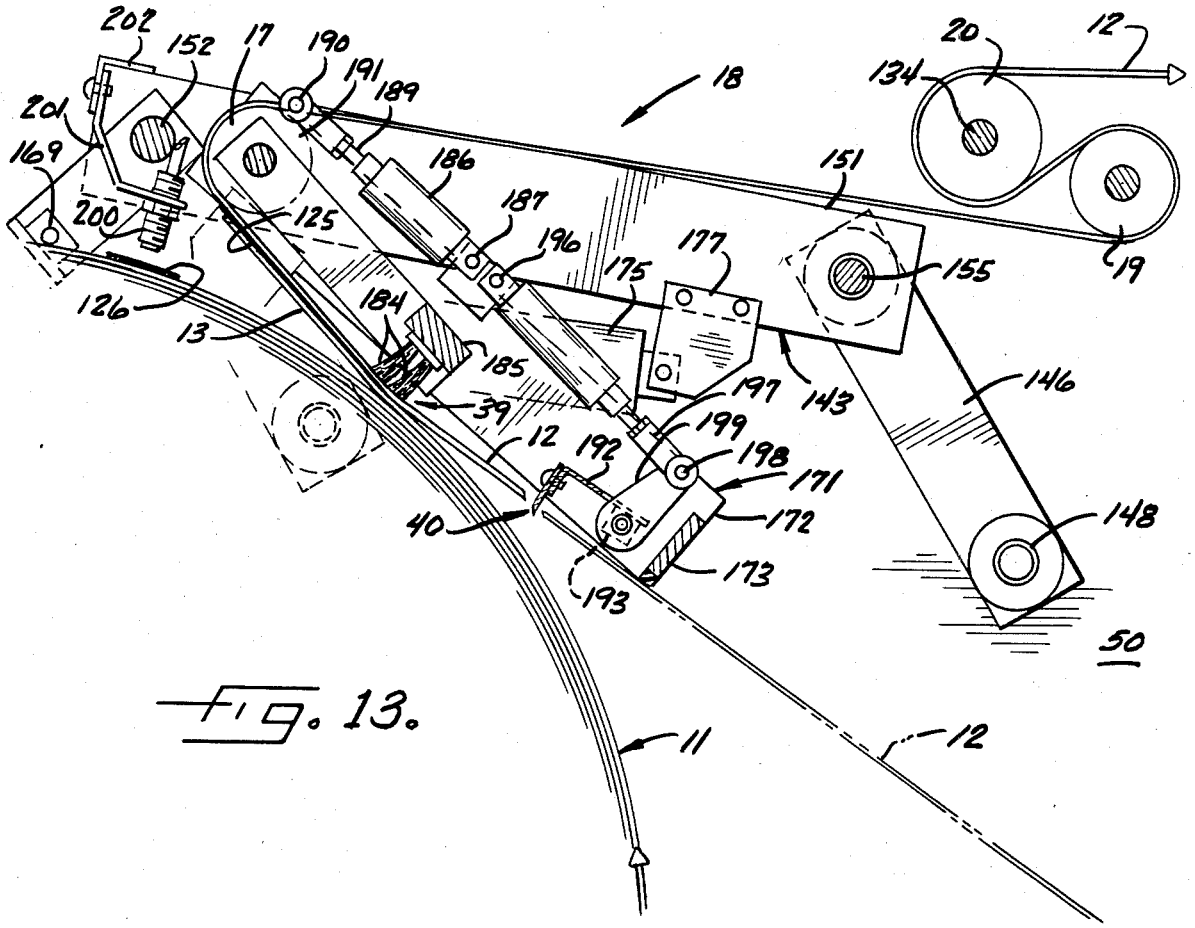
FIG. 13 is a view similar to FIG. 12 but showing the parts in a further moved position.

While the standby roll 11 is being accelerated, the splice head motor 159 is energized to drive the linear actuator 162 and move the carriage 143 down toward the roll, the motor being controlled by the photoelectric cells 169 to determine and maintain the position of the carriage (FIG. 11). The apparatus then is in condition to begin a splicing cycle which is initiated when, for example, the diameter of the active roll 10 is about four and one-half inches. Thus, the combined signals from the proximity switches 36 and 317 initiate the cycle in which first compressed air is admitted to the head end of the cylinder 175 to swing the frame 171 down so that the strip 181 on the bar 173 engages and deflects the running web 12 and the brush 39 and the knife 40 are ready to function. When the splice diameter is sensed, herein four inches, the photoelectric cell 200 is armed and, at about one-half revolution after the next time the flag 126 passes under this cell, compressed air is admitted to the rod end of the cylinder 186 and this causes the brush to press the running web against the periphery of the standby roll (FIG. 12). The next time that the flag passes under the photoelectric cell, compressed air is admitted to the rod end of the cylinder 195 to swing the knife down and sever the web 12 from the active roll (FIG. 13). As a result, the web 13 from the standby roll is drawn to the press.

At the same time as the knife 40 severs the web 12, the core brake 26 is fully energized to stop the core 14 of the exhausted roll and the belt brake 203 is energized so that, through the belt 37, the latter brake applies tension to the web 13. The web tension controller 330 controls the energization of the belt brake and hence the tension of the web 13 in the same manner as it controlled the core brake. The clutch 135 is disengaged at this time but the clutch 107 remains partially energized so that the motor 42 overcomes the drag in the drive to the belt 37. Also, compressed air now is admitted to the opposite ends of the cylinders 175, 186 and 195 to return the frame 171, the brush 39 and the knife 40 to their starting positions and the motor 159 is reversed to raise the carriage 143 to its inactive position.

With the core brake 26 stopped, the clutch assembly 255 is disengaged to separate the core 14 of the exhausted roll 10 from the splined shaft 256 and hence from the core brake. Thus, compressed air is admitted to the rod ends of the cylinders 281 and 282 to swing the lever 288 to the full line position illustrated in FIG. 18 and retract the splined shaft so that the outer sleeve 257 of the assembly is withdrawn from the hub 85 on the core and the inner sleeve 258 is retracted within the outer sleeve. The roll lift motor 227 then is energized to extend the screw 224 of the linear actuator 217 and lower the post 208 to its lowermost position shown in dashed lines in FIG. 15. As a result, the core is deposited on the ramp 242 (FIG. 17) and rolls into the trough 41.

Figure 1D:
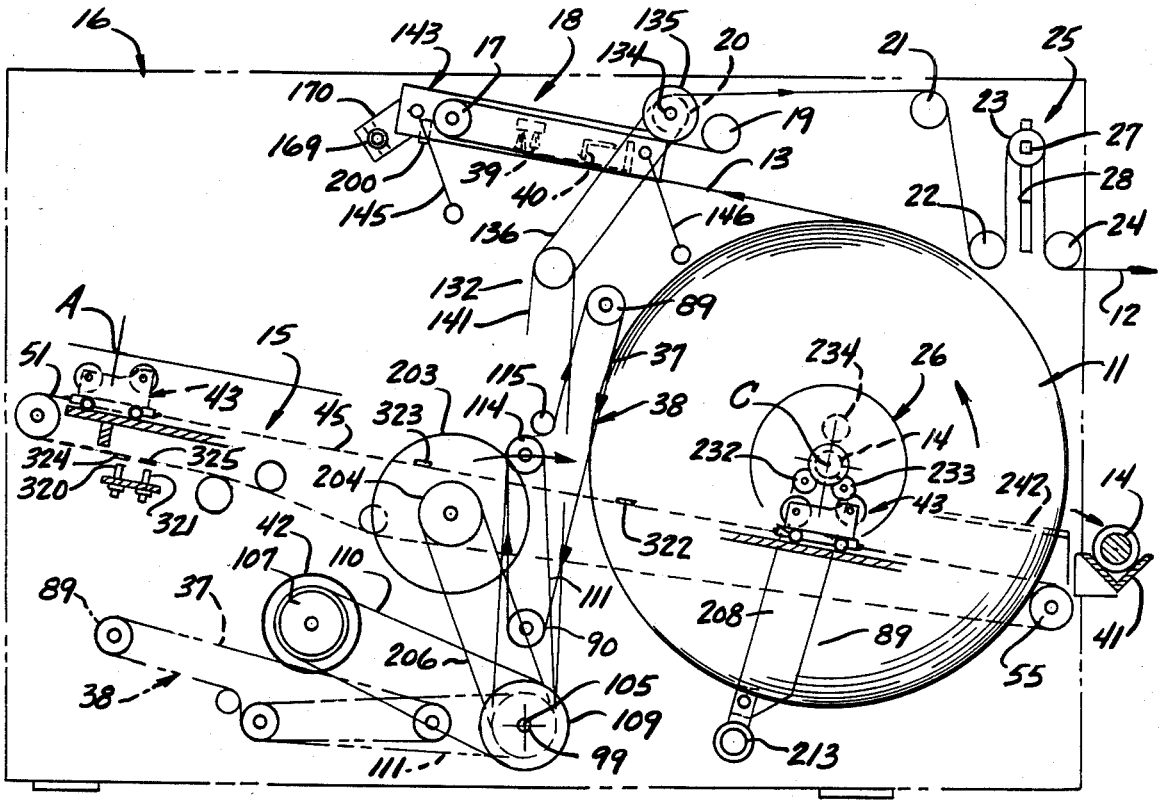
FIG. 1*d* is a view similar to FIG. 1*a* with the parts in a still further moved position.

With the web 13 running off the roll 11 and with the tension of the web being controlled through the belt brake 203 and the belt 37, the conveyor motor 61 is energized again and the chains 45 and 46 advance until the flags 324 and 325 are alined respectively with the photoelectric cells 320 and 321 at which time the cars 43 and 44 have carried the roll 11 to the station C and the conveyor motor is stopped. During this transfer, compressed air continues to be admitted to the rod end of the accelerator position cylinder 117 so that the arms 97 swing up and hold the belt 37 in frictional engagement with the periphery of the roll (FIG. 1*d*). Thus, the belt brake maintains control of the tension of the web 13 continuously as the roll is advanced from the station B to the station C and this control is continued as the roll lift motor 227 is energized in the reverse direction to raise the posts 208 and raise the roll up to its active position illustrated in FIG. 16. At this time, compressed air is admitted to the head end of the cylinder 281 (FIG. 14) to swing the lever 288 to its intermediate position and bring the outer sleeve 257 into frictional engagement with the shoulder 260 on the hub 85 of the core 14 (FIG. 18), the inner sleeve 258 remaining retracted within the outer sleeve. Rotation of the core, therefore, is imparted to the splined shaft 256 which then rotates at the same speed as the core. The disk 248 of the core brake rotates with the splined shaft and these parts rotate freely because the coils 246 of the brake are not energized. About five seconds later, compressed air is admitted to the head end of the cylinder 282 to swing the lever 288 to the broken line position illustrated in FIG. 14 and this projects the inner sleeve out of the outer sleeve so that the pin 267 in the hub 85 is received in two of the notches 268 (FIG. 19) and the core then positively drives the splined shaft and the disk 248. At that time, the belt brake 203 is deenergized and the core brake 26 is energized and assumes control of the tension of the web. With the core brake back in control, the conveyor motor 61 is energized in the reverse direction to drive the chains 45 and 46 back until the flag 322 opposes the photoelectric cell 320 and the cars 43 and 44 have returned to station A where they are ready to receive another standby roll. If necessary, at this time the lateral position of the new running web may be adjusted by using the side lay knob 336 on the control panel 329.

We claim:

1. In an apparatus for continuously supplying a web of sheet material, the combination of, a base, means on said base to support first and second circular rolls of web to turn about parallel axes, means for guiding the web from said first roll as the web is unwound from the latter at a preselected linear speed, a frictional drive member frictionally engaging the circular periphery of said second roll and operable when driven to rotate said second roll, clutch means, a power actuator operable through said clutch means to drive said frictional drive member at one speed and accelerate said second roll to a peripheral speed near the linear speed of the web from said first roll, means responsive to the linear speed of the web from said first roll and operable after operation of said power actuator to drive said frictional drive member at a different speed through said clutch means to cause said frictional drive member to rotate said second roll at a peripheral speed matching the linear speed of the web from said first roll, and means subsequently operable to attach the web from said first roll to the web on said second roll.

2. An apparatus as defined in claim 1 including, a first sensor responsive to the linear speed of the web from said first roll, a second sensor responsive to the peripheral speed of said second roll, and control means responsive to both of said sensors and operable to control rotation of said second roll at a peripheral speed matching the linear speed of the web from said first roll.

3. An apparatus as defined in claim 1 in which said means for guiding the web from said first roll includes an idler roller with the web extending around and turning the roller and in which said means responsive to the linear speed of the web from said first roll includes a first pulley driven directly by said idler roller, a second pulley driving said frictional drive member, and an endless belt connecting said pulleys.

4. An apparatus as defined in claim 1 in which said frictional drive member is an endless belt.

5. In an apparatus for continuously supplying a web of sheet material, the combination of, a base, means on said base to support first and second rolls of web to turn about parallel axes, means for guiding the web from said first roll as the web is unwound from the latter at a preselected linear speed, an endless belt having a run frictionally engaging the periphery of said second roll and operable when driven to rotate said second roll, clutch means having first and second conditions of engagement, a power actuator operable through said clutch means when the latter is in the first condition of engagement to drive said belt and accelerate said second roll to a predetermined peripheral speed less than the linear speed of the web from said first roll, a roller engaging the web from said first roll so as to be turned by the web at a speed correlated with said preselected linear speed, means driven by said roller and operable through said clutch means when the latter is in said second condition of engagement to accelerate said belt and hence said second roll to a peripheral speed matching said preselected linear speed, control means operable first to place said clutch means in said first condition of engagement and, after said second roll has been accelerated to said predetermined peripheral speed, to place said clutch means in said second condition of engagement thereby to accelerate the second roll to said matching speed, and means subsequently operable to attach the web from said first roll to the web on said second roll.

6. An apparatus as defined in claim 5 in which said control means includes a first sensor responsive to the linear speed of the web from said first roll and a second sensor responsive to the peripheral speed of said second roll, and said control means comparing the two speeds in controlling said clutch means for accelerating the second roll to said matching speed.

7. In an apparatus as defined in claim 5, an arm mounted on said base to swing about a third axis parallel to the axes of said rolls, means for supporting said endless belt on said arm for bodily movement therewith, and means urging said arm to swing about said third axis to place and hold said endless belt in frictional engagement with the periphery of said second roll.

8. In an apparatus as defined in claim 7, a rotary member mounted on said base to turn about said third axis, said power actuator and at least the part of said clutch means driven by the power actuator being stationarily mounted on said base, and first and second drive transmissions connecting said rotary member respectively to said part of said clutch means and to said endless belt.

9. An apparatus as defined in claim 8 in which said rotary member comprises two coaxial pulleys and said first and second transmissions respectively include first and second drive belts extending around the respective ones of said pulleys.

10. In an apparatus for continuously supplying a web of sheet material, the combination of, a base, means on said base to support first and second rolls of web to turn about parallel axes with the rolls located respectively at first and second stations, means for guiding the web from said first roll as the web is unwound from the latter at a preselected linear speed, a member frictionally engaging the periphery of said second roll and operable when driven to rotate said second roll, clutch means, a power actuator operable through said clutch means to drive said member and accelerate said second roll to a peripheral speed near the linear speed of the web from said first roll, means responsive to the linear speed of the web from said first roll and operable after operation of said power actuator to drive said member through said clutch means to accelerate said second roll to a peripheral speed matching the linear speed of the web from said first roll, splicing means subsequently operable to splice the web from said first roll to the web on said second roll, said clutch means thereafter being disengaged whereby said second roll drives said member, a carrier operable after the splicing of said webs to advance said second roll from said second station to said first station, means supporting said member on said base to move with said second roll and remain in frictional engagement with the periphery of the second roll as the latter is advanced to said first station, a brake stationarily mounted on said base, said brake being energized as said webs are spliced to apply a braking force to said member thereby to tension the web from said second roll, and means connecting said brake to said member in all positions of the latter whereby the brake continues to tension the web from the second roll as the said carrier advances said second roll to said first station.

11. Apparatus as defined in claim 10 including, an arm mounted on said base to turn about a third axis parallel to the axes of said rolls, means supporting said member on said arm, and means urging said arm to swing toward said second roll and hold said member in frictional engagement with the second roll while the latter is in said second station and while it is advanced to said first station.

12. Apparatus as defined in claim 11 including, a rotary element mounted on said base to turn about said third axis, said power actuator and said brake being stationarily mounted on said base, a first transmission connecting said element and said member, and second and third transmissions respectively connecting said element to said power actuator and said brake to permit transmission between said member and the power actuator and between said member and the brake in any angular position of said arm.

13. Apparatus as defined in claim 10 and having, a second brake mounted on said base at said first station and engageable with said second roll when the latter is at said first station, said second brake being operable when energized to apply a braking force to said second roll thereby to tension the web from the latter, and control means operable simultaneously to energize said second brake and deenergize said first brake when said roll is in said first station.

14. Apparatus as defined in claim 13 in which said control means also includes means responsive to the tension of the web from said second roll and operable to control the energization of each of said brakes thereby to continuously control the tension of the web from the second roll.

15. In an apparatus for continuously supplying a web of sheet material, the combination of, a base, a carrier on said base for supporting a standby roll of web and for advancing the roll from a first station to a second station to replace an active roll at the second station, means for guiding the web from said active roll as the web is unwound from the latter at a preselected speed, an arm mounted on said base to swing about an axis parallel to the axis of said standby roll, an endless belt carried by said arm, means urging said arm to swing about said axis thereby to bring said belt into engagement with the periphery of said standby roll and maintaining such engagement as said carrier advances the standby roll to said second station, clutch means, drive means operable through said clutch means to drive said belt when said standby roll is at said first station and accelerate the standby roll until its peripheral speed matches the linear speed of the web from said active roll, splicing means operable thereafter to splice the web from said standby roll to the web from said active roll whereby the web is drawn from the standby roll, said clutch means disengaging said drive means from said belt upon such splicing whereby said standby roll drives the belt, and a brake connected to said belt and operable when engaged to apply a braking force to the belt thereby to tension the web from said standby roll, said brake being engaged upon splicing of said webs and remaining engaged as said carrier advances said standby roll to said second station.

* * * * *